US007658480B2

(12) United States Patent
Uehara et al.

(10) Patent No.: US 7,658,480 B2
(45) Date of Patent: Feb. 9, 2010

(54) METHOD OF LIQUID FILLING OF CARTRIDGE, LIQUID FILLING DEVICE, AND CARTRIDGE

(75) Inventors: Yutaka Uehara, Nagano (JP); Morio Sato, Nagano (JP); Hiroshi Yamazaki, Nagano (JP); Koichi Toba, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 395 days.

(21) Appl. No.: 11/288,671

(22) Filed: Nov. 29, 2005

(65) Prior Publication Data

US 2006/0132555 A1 Jun. 22, 2006

(30) Foreign Application Priority Data

Nov. 29, 2004 (JP) ..... 2004-343427
Nov. 29, 2004 (JP) ..... 2004-343428
Nov. 29, 2004 (JP) ..... 2004-343429

(51) Int. Cl.
*B41J 2/175* (2006.01)

(52) U.S. Cl. ..... 347/85; 347/86

(58) Field of Classification Search ..... 347/85, 347/86, 87

See application file for complete search history.

(56) References Cited

U.S. PATENT DOCUMENTS 3,720,473 A * 3/1973 Nakata ..... 401/40
5,329,294 A 7/1994 Ontawar et al.
5,495,272 A * 2/1996 Yamaguchi ..... 347/28
5,515,663 A * 5/1996 Allgeier et al. ..... 53/467
5,572,852 A * 11/1996 Crystal et al. ..... 53/428
5,600,358 A * 2/1997 Baldwin et al. ..... 347/87
6,007,192 A 12/1999 Ahn (Continued)

FOREIGN PATENT DOCUMENTS

CN 1390705 A 1/2002

(Continued)

OTHER PUBLICATIONS

Search Report in European Patent Appln. No. 05025966.2, dated Apr. 6, 2006.

(Continued)

*Primary Examiner*—Anh T. N. Vo
(74) *Attorney, Agent, or Firm*—Stroock & Stroock & Lavan LLP

(57) ABSTRACT

A method of refilling liquid into a cartridge according to the present invention is a method of liquid refilling, through which liquid is refilled into a used cartridge (1) in a liquid jet apparatus, comprising: a film removing process, in which an injection hole film (90) adhered around an air discharge opening (21), which communicates with the interior of the used cartridge (1), to seal the air discharge opening (21) is removed in order to make the air discharge opening (21) open; a liquid injecting process, in which liquid is injected into the used cartridge (1) through the air discharge opening (21) that has been made open in the injection hole film piercing process; and an injection hole film rewelding process, in which the film is rewelded using a surface other than an originally welded surface as a rewelded surface in order to seal again the air discharge opening (21), through which the liquid is injected in the liquid injecting process.

16 Claims, 20 Drawing Sheets

| | SEQUENCE | VALVE STATE | | | | |
|---|---|---|---|---|---|---|
| | | ① | ② | ③ | ④ | ⑤ |
| 1 | VACUUM PULLING | O | S | S | S | O |
| 2 | INJECTION | S | O | S | O | S |
| 3 | INK REPLENISHMENT | S | O | O | S | S |
| 4 | INK SUCTION | S→O | S | S | S | O→S |
| 5 | FINISH | S | S | S | S | S |

U.S. PATENT DOCUMENTS

| | | | | |
|---|---|---|---|---|
| 6,238,042 | B1 * | 5/2001 | Kobayashi et al. | 347/86 |
| 6,364,473 | B1 | 4/2002 | Liu | |
| 6,659,599 | B2 * | 12/2003 | Putman et al. | 347/86 |
| 6,773,087 | B2 * | 8/2004 | Wazana et al. | 347/22 |
| 6,945,641 | B2 | 9/2005 | Sakai et al. | |
| 6,951,388 | B2 * | 10/2005 | Sasaki | 347/86 |
| 7,104,639 | B2 * | 9/2006 | Hermes et al. | 347/85 |
| 7,213,913 | B2 | 5/2007 | Sakai et al. | |
| 2003/0048339 | A1 | 3/2003 | Sasaki | |
| 2004/0066429 | A1 | 4/2004 | Wazana et al. | |
| 2004/0174417 | A1 | 9/2004 | Kobayashi et al. | |

FOREIGN PATENT DOCUMENTS

| | | | |
|---|---|---|---|
| EP | 1258361 | A1 | 11/2002 |
| EP | 1258362 | A1 | 11/2002 |
| JP | 10-193635 | A | 7/1998 |
| JP | 11-207990 | A | 8/1999 |
| WO | WO 2004/023216 | A1 | 3/2004 |

OTHER PUBLICATIONS

Search Report from European patent appln. No. 05025966.2-2304 (Oct. 31, 2006).

* cited by examiner

INK INJECTING PROCESS

O : open
S : shut

| | SEQUENCE | VALVE STATE ① | ② | ③ | ④ | ⑤ |
|---|---|---|---|---|---|---|
| 1 | VACUUM PULLING | O | S | S | S | O |
| 2 | INJECTION | S | O | S | O | S |
| 3 | INK REPLENISHMENT | S | O | O | S | S |
| 4 | INK SUCTION | S→O | S | S | S | O→S |
| 5 | FINISH | S | S | S | S | S |

INJECTION HOLE FILM WELDING PROCESS

METHOD OF LIQUID FILLING OF CARTRIDGE, LIQUID FILLING DEVICE, AND CARTRIDGE

BACKGROUND OF THE INVENTION

The present invention relates to a method of filling liquid into a cartridge of a liquid jet apparatus such as a printer, display manufacturing device, electrode forming device, or biochip manufacturing device having a liquid jet head that jets liquid droplets through openings of nozzles. The present invention also relates to a liquid filling device, and a cartridge.

Even though a liquid jet apparatus having a liquid jet head that jets liquid droplets through openings of nozzles jets various kinds of liquid, what is most widely known is a recording head mounted on an ink jet recording device. Therefore, the ink jet recording device will be used as an example for the description.

The ink jet recording device includes a liquid jet head that ejects liquid, such as ink, and records images such as letters, figures or the like; and a cartridge that stores the liquid, such as ink, which is to be supplied to the liquid jet head, and, in general, the cartridge can be detached from the ink jet recording device for replacement. When the ink in the cartridge is used up, and thus images cannot be recorded, images can be recorded again by replacing the used cartridge storing no ink with a brand-new cartridge storing ink.

In recent years, it has been sought that the used cartridge is injected with ink for recycling, since serious problems such as increase of waste and environmental load occur when the used cartridge is disposed after a single-time usage.

In order to reuse the used cartridge, there is proposed a refilling method of the ink cartridge of the ink jet recording device, in which ink remaining in an ink bag is discharged and a specified amount of ink is injected into the ink bag (for example, see Patent Document 1). In the method disclosed in Patent Document 1, the ink bag is pressed by a pressing plate in a low-pressure chamber in order to discharge the ink remaining in the ink bag, and then the specified amount of ink is injected into the ink bag.

In addition, there is proposed a method of ink replenishment, through which ink is replenished into the used cartridge storing no ink (see Patent Document 2). In the method disclosed in Patent Document 2, ink is replenished by a replenishing unit while a suction unit is sucking the ink in an ink tank.

Patent Document 1: Japanese Patent Laid-Open No. 10-193635

Patent Document 2: Japanese Patent Laid-Open No. 11-207990

However, in the method disclosed in Patent Document 1, the specified amount of ink is injected into the ink bag while the ink bag is pressed by the pressing plate in the low-pressure chamber and thus the ink remaining in the ink bag is discharged. Therefore, the method cannot be applied to a hard case cartridge having a fixed shape. In addition, since the ink is discharged from the ink bag by a device having a vertically movable pressing plate in the low-pressure chamber, the configuration of the device and the process become complicated. As a result, the recycling cost increases.

In addition, in the method disclosed in Patent Document 2, since ink is replenished while the ink in the cartridge (ink tank) is being sucked, the degassed rate of the cartridge can be decreased, or a great amount of deteriorated ink can remain in the ink bag due to the increased viscosity thereof (the viscosity is increased by drying) so as to be mixed with the replenished ink, or the replenished ink can contain many air bubbles, and thereby it is highly likely that the ink cannot ensure a required quality when reused. In contrast, when it is sought that the remaining ink is discharged completely, it is likely that the replenished ink can be mixed with the remaining ink then discharged, and thereby the amount of replenished ink can be decreased. That is, it is difficult to ensure the quality and yield of the ink of the recycled cartridge at the same time, and thereby the both methods are not satisfactory. Furthermore, since ink is injected from a supplying opening that supplies ink into a printer or the like and then held in an ink holding member in the cartridge, the ink flowing direction during suction or injection is opposite to the ink flowing direction during using, and the ink bubbles so as to remain in the form of air bubbles in the cartridge. As a result, it is likely to cause the inferior jetting of the jet head while the recycled cartridge is being used.

As described above, Patent Documents 1 and 2 never mention how to ensure the yield of the cartridge by sealing the ink-refilled recycled cartridge reliably, much less study about the above matter.

Further, Patent Documents 1 and 2 never mention how to remove the air bubbles in a recycled cartridge and how to prevent the inferior jetting of the liquid jet head when the recycled cartridge is used, much less study about the above matters.

SUMMARY OF THE INVENTION

An advantage of the invention is to provide a method of and a device for effectively filling liquid into a cartridge, and the cartridge manufactured by the method and/or the device.

Another advantage of the invention is to provide a method of refilling liquid into a cartridge that effectively refills liquid into the used cartridge in the liquid jet apparatus and a liquid refilling device.

Another advantage of the invention is to provide a method of refilling liquid into a cartridge that ensures the yield of the cartridge by refilling liquid effectively into the used cartridge in the liquid jet apparatus and then sealing the ink-refilled recycled cartridge reliably, a liquid refilling device and a refilling cartridge.

Yet another advantage of the invention is to provide a method of refilling liquid into a cartridge that refills liquid effectively into the used cartridge in the liquid jet apparatus and prevents inferior jetting of the liquid jet head when the recycled cartridge is used-and a liquid refilling device.

Still another advantage of the invention is to provide a method of filling liquid into a cartridge that fills liquid effectively into the cartridge mountable to a liquid jet apparatus and prevents inferior jetting of the liquid jet head, and a liquid filling device.

In order to achieve at least one of the above advantages, a method of refilling liquid into a cartridge according to the present invention can refill liquid into a used cartridge having an opening communicating with an interior of the used cartridge and a first film welded to an originally welded surface around the opening to seal the opening, and includes: a film removing process, in which the first film is removed in order to communicate the opening with an exterior of the used cartridge; a liquid injecting process, in which liquid is injected into the used cartridge through the opening communicated in the film removing process; and a rewelding process, in which a second film is rewelded using a surface other than the originally welded surface as a rewelded surface (hereinafter referred to as 'rewelded surface') in order to seal again the opening, through which the liquid has been injected in the liquid injecting process.

In addition, in order to achieve at least one of the advantages, a device of refilling liquid into a cartridge according to the invention can refill liquid into a used cartridge having an opening communicating with an interior of the used cartridge and a first film welded to an originally welded surface around the opening to seal the opening, and includes: a film removing unit that removes the first film in order to communicate the opening with the exterior of the used cartridge; a liquid injecting unit that injects liquid into the used cartridge through the opening communicated by the film removing unit; and a rewelding unit that rewelds a second film using a surface other than the originally welded surface as a rewelded surface in order to seal again the opening, through which the liquid has been injected by the liquid injecting unit.

Furthermore, in order to achieve at least one of the advantages, a refilling cartridge according to the invention is a cartridge manufactured by refilling liquid into a used cartridge having an opening communicating with an interior of the used cartridge and a first film welded to an originally welded surface around the opening to seal the opening, in which the first film is removed in order to communicate the opening with an exterior of the used cartridge, and a second film is rewelded using a surface other than the originally welded surface as a rewelded surface in order to seal the opening again after the liquid is injected.

That is, in the method of refilling liquid into a cartridge and the liquid refilling device of the invention, the first film welded around the opening of the used cartridge to seal the opening that communicates with the interior of the cartridge is removed in order to communicate the opening, and then the liquid is injected into the used cartridge though the opening that has been made open. Then, the second film is rewelded using a surface other than the originally welded surface as a rewelded surface in order to seal the opening, through which the liquid has been injected.

As a result, it is possible to obtain a welding quality ensuring a welding strength having no liquid leakage with no change in the shape of the cartridge. In addition, since the second film is rewelded using a surface other than an originally welded surface as a rewelded surface, the reliability of the welding improves. In this case, if a film which is the same as the originally attached film is used, the reliability against the life span deterioration can be ensured. As described above, since the used cartridge can be recycled effectively with a simple process, a user can be provided with a high-quality used cartridge at a low recycling cost. Furthermore, since the used cartridge can be reused by injecting liquid into the cartridge, the decrease in environmental load accompanied by the reduction of waste and the cost down owing to the reusing of parts can be achieved, so that users can be provided with cartridge at a low price. In this case, if a film which is the same as the originally attached film is used, the reliability against the life span deterioration can be ensured.

In the method of refilling liquid into a cartridge according to the invention, if the rewelded surface is formed at a recessed portion around the opening that is deeper than the originally welded surface, the rewelded surface is deeper than the other adjacent portion and thus covered with the first film. Therefore, the rewelded surface is rarely damaged while the cartridge is being used. As a result, the second film can be rewelded to a surface with no damage, which leads to reliable rewelding of the second film.

In the method of refilling liquid into a cartridge according to the invention, an inclined surface inclined downward toward the interior of the cartridge from an edge of the opening is formed at the opening of the cartridge, and if the second film is rewelded to the inclined surface, the second film is rewelded to the inclined surface that is inclined downward to the interior of the cartridge from the edge of the opening. Therefore, the film can be rewelded to the inclined surface easily with a welding jig. As a result, the opening can be sealed more reliably.

In the method of refilling liquid into a cartridge according to the invention, the cartridge has a pressure control valve that controls the supply pressure of the liquid at a liquid supplying opening that supplies the liquid to the liquid jet apparatus, and if the cartridge holds the liquid therein by the pressure control of the pressure control valve, the liquid is injected in the same direction as the liquid flowing direction when the cartridge is used. Therefore, the liquid can be injected smoothly while air bubbles seldom enter or remain.

In the method of refilling liquid into a cartridge according to the invention, the cartridge has the liquid supplying opening that supplies the liquid to the liquid jet apparatus, and if the liquid remaining in the used cartridge is extracted from the liquid supplying opening (liquid extracting process) prior to the liquid injecting process, the liquid is injected into the cartridge after the ink remaining in the used cartridge is extracted, and thereby the effect of the inferior liquid can be decreased. In addition, since the liquid remaining in the cartridge is extracted through the liquid supplying opening, during the liquid extracting process, the liquid flows in the same direction as the liquid flowing direction when the cartridge is used, and thereby the liquid can be extracted smoothly. Furthermore, since it is possible to use an extracting tool having the same configuration as that of the liquid jet apparatus, common parts can be used for the device and the tool, which leads to the reduction of the device cost, and the liquid can be extracted smoothly.

In the method of refilling liquid into a cartridge according to the invention, if liquid is injected into the cartridge, from which the remaining liquid has been extracted in the liquid extracting process, through the opening, not through the liquid supplying opening in the liquid injecting process, the liquid can be injected efficiently in a short time while no air bubbles enter.

In the method of refilling liquid into a cartridge according to the invention, if the opening is an opening communicating with an ink reservoir chamber upstream of the pressure control valve, the liquid is injected in the same direction as the liquid flowing direction when the cartridge is used. Therefore, the liquid can be injected smoothly while air bubbles seldom enter or remain.

In the method of refilling liquid into a cartridge according to the invention, if the first film on the opening is removed by forming a through-hole in the first film on the opening when the first film on the opening is removed in the film removing process, and the opening can be made open with no damage to the cartridge or the like by forming the through-hole in the first film on the opening when liquid is injected into the cartridge through the opening in the liquid injecting process, the rewelded surface is rarely damaged. Therefore, the second film can be rewelded to a surface with no damage, which leads to reliable rewelding of the second film. In addition, the liquid can be injected effectively in a short time while no air bubbles enter.

According to the refilling cartridge of the invention, users can reuse the refilling cartridge having welding quality that ensures welding strength including no liquid leakage with no change in the shape of the cartridge. In addition, since the second film is rewelded using a surface other than an originally welded surface as a rewelded surface, the welding reliability increases, and the user satisfaction improves. In this case, if a film which is the same as the originally attached film is used, the reliability against the life span deterioration can be ensured. Furthermore, since the used cartridge can be reused by injecting liquid into the cartridge, the decrease in environmental load accompanied by the reduction of waste and the cost down owing to the reusing of parts can be achieved, so that users can be provided with cartridge at a low price. As described above, since the used cartridge can be recycled effectively with a simple process, a user can be provided with a high-quality used cartridge at a low recycling cost.

In order to achieve at least one of the above advantages, a method of filling liquid into a cartridge according to the present invention can fill liquid into a cartridge mountable to a liquid jet apparatus, and includes a liquid injecting process of injecting liquid into the cartridge; and a suction process of sucking a predetermined amount of liquid from the inside thereof through a liquid supplying opening, through which the cartridge supplies the liquid to the liquid jet apparatus, after the liquid is injected in the liquid injecting process.

In addition, in order to achieve at least one of the above advantages, a device of filling liquid into a cartridge according to the invention can fill liquid into a cartridge mountable to a liquid jet apparatus, and includes a liquid injecting unit that injects liquid into the cartridge; and a suction unit that sucks a predetermined amount of liquid from the inside of the cartridge through a liquid supplying opening, through which the cartridge supplies the liquid to the liquid jet apparatus, after the liquid is injected by the liquid injecting unit.

That is, according to the method of filling liquid into a cartridge and the liquid filling device according to the invention, after liquid is injected into the cartridge, a predetermined amount of liquid is sucked from the inside of the cartridge through the liquid supplying opening that supplies the liquid to the liquid jet apparatus.

Therefore, if the predetermined amount of liquid is sucked from the inside of the cartridge through the liquid supplying opening after the injection of the liquid, air bubbles rarely remain in the cartridge. In addition, since the air bubbles near the liquid supplying opening that influence on the jetting performance of the jet head most can be removed, it is possible to ensure the jetting characteristic of the liquid jet apparatus. In particular, in case where the invention is applied to the used cartridge, it is possible to ensure the jetting characteristic of the liquid jet apparatus in the used cartridge as great as that of new cartridge. Furthermore, since no external pressure is applied when the air bubbles are removed, the cartridge is rarely damaged, and the cartridge can be recycled more times. As described above, in particular, in the case where the invention is applied to the used cartridge, since the used cartridge can be recycled effectively with a simple process, a user can be provided with a high-quality used cartridge at a low recycling cost. Furthermore, since the used cartridge can be reused by injecting liquid into the cartridge, the decrease in environmental load accompanied by the reduction of waste and the cost down owing to the reusing of parts can be achieved, and thereby users can be provided with cartridge at a low price.

In the embodiment of the invention, the cartridge has a pressure control valve that controls the supplying pressure of the liquid at the liquid supplying opening, and since no absorbing material or the like that holds the liquid in a liquid reservoir chamber of the cartridge exists in the case of a cartridge, in which the liquid is held by the pressure control of the pressure control valve, the liquid can move smoothly when the liquid is sucked, extracted or injected, the liquid can be refilled smoothly, and the effect of the invention becomes remarkable.

In the suction process, when the amount of the liquid corresponding to at least the volume of the flow passage from the pressure control valve to the liquid supplying opening among the liquid supplying passages in the cartridge is sucked, the air bubbles in the flow passage from the pressure control valve to the liquid supplying opening can be removed reliably. Even when air bubbles remain upstream of the pressure control valve, since the air bubbles cannot enter a portion downstream of the pressure control valve, the jetting troubles can be prevented reliably.

In the suction process, if the liquid is sucked and held in a liquid holding portion having the volume corresponding to the amount of the liquid sucked from the liquid supplying opening in the suction process, since the liquid is sucked from the liquid supplying opening as much as the volume of the liquid holding portion, a constant volume of liquid can be sucked stably at all times, the loss of liquid due to excessive suction or the air bubble remaining due to the suction shortage can be prevented reliably.

When the suction process is performed by opening the opening and closing valve, the negative pressure applied to the vicinities of the liquid supplying opening is increased abruptly from a state in which the predetermined negative pressure is accumulated in the liquid holding portion by opening the opening and closing vale provided upstream of the liquid holding portion. Therefore, the suction speed of the liquid in the cartridge is abruptly increased, and thus the liquid can be discharged from the liquid supplying opening with no stopping. As a result, the liquid containing air bubbles filled in the cartridge is sucked strongly, and therefore the liquid containing no air bubble is filled into the liquid supplying opening or the like, and thereby liquid can be jetted from the liquid jet apparatus reliably. As described above, since strong negative pressure can be applied to the vicinity of the liquid supplying opening with no particular increase in the sucking force, air bubbles or liquid can be sucked reliably by simple equipment.

In the embodiment of the invention, if the liquid remaining in the used cartridge is extracted from the liquid supplying opening (liquid extracting process) prior to the liquid injecting process, the liquid is injected into the cartridge after the liquid remaining in the used cartridge is extracted. Therefore, the effect of the inferior liquid can be decreased. In addition, since the liquid remaining in the cartridge is extracted through the liquid supplying opening, during the liquid extracting process, the liquid flows in the same direction as the liquid flowing direction when the cartridge is used, and thus the liquid can be extracted smoothly. Furthermore, since it is possible to use an extracting jig having the same configuration as that of the liquid jet apparatus, common parts can be used for the apparatus and the tool, which leads to the reduction of the device cost, and the liquid can be extracted smoothly.

In the embodiment of the invention, if liquid is injected into the cartridge, from which the remaining liquid has been extracted in the liquid extracting process, through the second opening, not through the liquid supplying opening, the liquid can be injected efficiently in a short time while no air bubbles enter.

In the embodiment of the invention, if the second opening communicates with the ink reservoir chamber upstream of the pressure control valve, the liquid is injected in the same direction as the liquid flowing direction when the cartridge is used. Therefore, the liquid can be injected smoothly while air bubbles seldom enter or remain.

In the embodiment of the invention, the liquid is injected into the cartridge in a state in which the pressure of the cartridge, from which the liquid is extracted in the liquid extracting process, is reduced in advance so as to be in the range of 600 to 3800 Pa. As a result, since the liquid is injected in a state the air in the cartridge is sufficiently removed, the liquid can be refilled smoothly while no air bubbles enter the cartridge. Particularly, a cartridge in which a pressure control valve is built, like the cartridge of the embodiment, is effective since the resistance of the air passing through the pressure control valve exerts a bad influence on a filling property or leaves air bubbles when air bubbles exist in the cartridge. In addition, since the pressure in the cartridge is not reduced excessively, it can be prevented that a small amount of liquid remaining in the cartridge is evaporated and solidified, or severe bubbling exerts a bad influence upon a filling property.

In case of an ink cartridge into which liquid has been refilled by a liquid refilling method according to the present invention, the refilling is complete by sucking a predetermined amount of liquid from the inside of the cartridge through a liquid supplying opening, through which the cartridge supplies the liquid to a liquid jet apparatus, after the injection of liquid. That is, after the liquid injection, the predetermined amount of the liquid is sucked from the inside of the cartridge though the liquid supplying opening. Consequently, it is possible to provide an ink cartridge into which liquid has been refilled with substantially no air bubble. Further, since it is possible to surely eliminate air bubble in the vicinity of the ink supplying opening, which will most adversely affect the jetting performance of the liquid head if remains in that portion, the refilled cartridge can ensure the jetting performance of the liquid jet apparatus to be the same as that of a new cartridge. Furthermore, since a pressure is not applied to the exterior of the cartridge when the air bubble is eliminated, the cartridge is not damaged, and the cartridge can be recycled more times. As described above, since the used cartridge can be recycled effectively with a simple process, a user can be provided with a high-quality used cartridge at a low recycling cost. Moreover, since the used cartridge can be reused by injecting liquid into the cartridge, the decrease in environmental load accompanied by the reduction of waste and the cost down owing to the reusing of parts can be achieved, and thereby users can be provided with cartridge at a low price.

In order to achieve at least one of the above advantages, a method of liquid refilling into a cartridge according to the present invention can refill liquid into a used cartridge mountable to a liquid jet apparatus, and includes a liquid extracting process, in which liquid remaining in the used cartridge is extracted; a remaining amount checking process, in which it is checked whether the amount of the liquid remaining in the cartridge after the remaining liquid is extracted in the extracting process occupies a predetermined ratio or less of the total amount of liquid to be filled in a new cartridge; and a liquid injecting process, in which liquid is injected into the used cartridge checked to contain the amount of the remaining liquid equal to or less than the predetermined ratio in the remaining amount checking process.

In addition, in order to achieve at least one of the above advantages, a device of refilling liquid into a cartridge according to the invention can refill liquid into a used cartridge mountable to a liquid jet apparatus, and includes: a liquid extracting unit that extracts liquid remaining in the cartridge; a measuring device that measures whether an amount of the liquid remaining in the cartridge after the liquid is extracted by the liquid extracting unit occupies a predetermined ratio or less of the total amount of liquid to be filled into a new cartridge; and a liquid injecting unit that injects liquid into the cartridge checked to contain the amount of the liquid, measured by the measuring unit, equal to or less than the predetermined ratio.

That is, according to the method of refilling liquid into a cartridge of the invention, liquid remaining in the used cartridge is extracted. In addition, it is checked whether the amount of the liquid remaining in the cartridge after the liquid is extracted by the liquid extracting unit occupies a predetermined ratio or less of the total amount of liquid to be filled into a new cartridge, and liquid is injected into the used cartridge checked to contain the amount of the remaining liquid equal to or less than the predetermined ratio.

Therefore, since liquid is injected into only the cartridge checked to contain the amount of the liquid equal to or less than the predetermined ratio, it is possible to ensure the quality of the liquid filled into the cartridge, in which the effect of the inferior liquid suffering from the reduction of the degassed rate, the viscosity increase due to drying or the like can be almost ignored. Therefore, the yield of the liquid to be replenished can be ensured while the remaining liquid is discharged sufficiently, and both of the quality and yield of the liquid in the recycled cartridge can be ensured. In addition, since it is not required to apply external pressure to the cartridge, the cartridge is rarely damaged and the cartridge can be recycled more times. As described above, since the used cartridge can be recycled effectively with a simple process, a user can be provided with a high-quality used cartridge at a low recycling cost. Furthermore, since the used cartridge can be reused by injecting liquid into the cartridge, the decrease in environmental load accompanied by the reduction of waste and the cost down owing to the reusing of parts can be achieved, and thus users can be provided with cartridge at a low price.

In the method of refilling liquid into a cartridge of the invention, when the predetermined ratio in the remaining amount checking process is 6 volume %, it is possible to ensure the quality of the liquid such that the effect of the inferior liquid remaining in the cartridge can be ignored, and the used cartridge can be refreshed by replacing the liquid in the used cartridge with replenished liquid reliably. In addition, the yield of the liquid to be refilled can be ensured while the remaining liquid is discharged sufficiently, and thus both of the quality and yield of the liquid in the recycled cartridge can be ensured.

In the method of refilling liquid into a cartridge of the invention, when the remaining liquid in the cartridge is extracted in the liquid extracting process, a predetermined amount of liquid corresponding to the surface area of the cartridge is made to remain in the cartridge, and when the liquid is injected into the cartridge, in which the predetermined amount of liquid remains, in the liquid injecting process, the predetermined amount of liquid according to the surface area of the cartridge is made to remain, whereby the fluidity of the liquid to a portion, into which liquid is hard to flow (for example, narrow liquid flow passage), or a portion, at which the liquid is hard to be delivered, improves, the filling characteristics of the liquid improves, and air bubbles rarely remain. In this case, a great amount of liquid remains if the surface area of the cartridge is large, and a small amount of liquid remains if the surface area of the cartridge is small. As a result, the above function works effectively.

In the method of refilling liquid into a cartridge of the invention, if the cartridge has a pressure control valve that controls the supplying pressure of the liquid with respect to the liquid supplying opening, and no absorbing material or the like that holds the liquid in a liquid reservoir chamber of the cartridge exists in the case of a cartridge, in which the liquid is held by the pressure control of the pressure control valve, the liquid can move smoothly when the liquid is sucked, extracted or injected, the liquid can be refilled smoothly, and the effect of the invention becomes remarkable.

In the method of refilling liquid into a cartridge of the invention, when the liquid remaining in the used cartridge is extracted from the liquid supplying opening in the liquid extracting process that supplies the liquid to the liquid jet apparatus, since the liquid remaining in the cartridge is extracted from the liquid supplying opening that supplies the liquid to the liquid jet apparatus, the liquid flows in the same direction as the liquid flowing direction when the cartridge is used, whereby the liquid can be extracted smoothly. Furthermore, since it is possible to use an extracting jig having the same configuration as that of the liquid jet apparatus, common parts can be used for the device and the tool, which leads to the reduction of the device cost, and the liquid can be extracted smoothly.

In the method of refilling liquid into a cartridge of the invention, if liquid for refilling is injected into the cartridge, from which the remaining liquid has been extracted in the liquid extracting process, through the second opening, not through the liquid supplying opening, the liquid can be injected efficiently within a short time while no air bubbles enter.

In the method of refilling liquid into a cartridge of the invention, if the second opening communicates with the liquid reservoir chamber upstream of the pressure control valve, the liquid is injected in the same direction as the liquid flowing direction when the cartridge is used. Therefore, the liquid can be injected smoothly while air-bubbles seldom enter or remain.

In addition, according to the liquid refilling device of the cartridge of the invention, the liquid remaining in the used cartridge is extracted. Furthermore, it is measured whether the amount of the liquid remaining in the cartridge after the liquid is extracted occupies the predetermined ratio or less, and then liquid is injected into only the cartridge containing the measured amount of the remaining liquid equal to or less than the predetermined ratio of the total amount of the liquid to be filled into the new cartridge.

Therefore, since liquid for refilling is injected into only the cartridge checked to contain the amount of the liquid equal to or less than the predetermined ratio, it is possible to ensure the quality of the liquid filled into the cartridge, in which the effect of the inferior liquid suffering from the reduction of the degassed rate, the viscosity increase due to drying or the like can be almost ignored. Therefore, the yield of the liquid to be replenished can be ensured while the remaining liquid is discharged sufficiently, and both of the quality and yield of the liquid in the recycled cartridge can be ensured. In addition, since it is not required to apply external pressure to the cartridge, the cartridge is rarely damaged and the cartridge can be recycled more times. As described above, since the used cartridge can be recycled effectively with a simple process, a user can be provided with a high-quality used cartridge at a low recycling cost. Furthermore, since the used cartridge can be reused by injecting liquid into the cartridge, the decrease in environmental load accompanied by the reduction of waste and the cost down owing to the reusing of parts can be achieved, and thereby users can be provided with cartridge at a low price.

In the present invention, the liquid for refilling (the liquid to be replenished) may be the same as the liquid filled originally and consumed, or may be liquid of the same group or similar liquid. For example, in case where the liquid is ink, the liquid for refilling may be ink of the same color, or may be ink of the same color group or ink of similar color. Here, the ink of the same group means ink having colorant or color material of the same group, which has substantially the same chromatic characteristic as that of ink filled originally and consumed (for example, red ink and light red ink, etc.), and the ink of similar color means ink having colorant or color material which has similar chromatic characteristic as that of ink filled originally and consumed (for example, red ink and orange ink, etc.) Moreover, in some cases, the liquid for refilling maybe ink which is completely different in color from the ink filled originally and consumed.

The present disclosure relates to the subject matter contained in Japanese patent application Nos. 2004-343427 (filed on Nov. 29, 2004), 2004-343428 (filed on Nov. 29, 2004), and 2004-343429 (filed on Nov. 29, 2004), each of which is expressly incorporated herein by reference in its entirety.

DESCRIPTION OF THE PREFERRED EMBODIMENT

Hereinafter, the best mode for carrying out the present invention will be described.

Meanwhile, in the following description, the ink jet recording device (hereinafter referred to as 'recording device'), which is a liquid jet apparatus, will be used as an example. The recording device is an image recording device that records letters or images by landing liquid droplets (liquid ink) ejected from openings of nozzles on a surface of a recording sheet (a printing sheet) that is an object to be jetted.

The recording device includes an ink cartridge (hereinafter referred to as 'cartridge') 1 and a carriage, to which a recording head is attached.

The carriage is connected with a stepping motor through a timing belt and guided to a guide bar so as to reciprocate in the width direction of the recording sheet. The carriage is shaped like a box with the upper surface open and attached to a surface facing the recording sheet (a bottom surface in the present example) to make nozzles of the recording head exposed. In addition, the cartridge 1 is mounted on the carriage.

Furthermore, ink is supplied to the recording head from the cartridge 1, and images or letters are printed in dot matrix by ejecting ink droplets onto the recording sheet from the moving cartridge.

Figure 1:
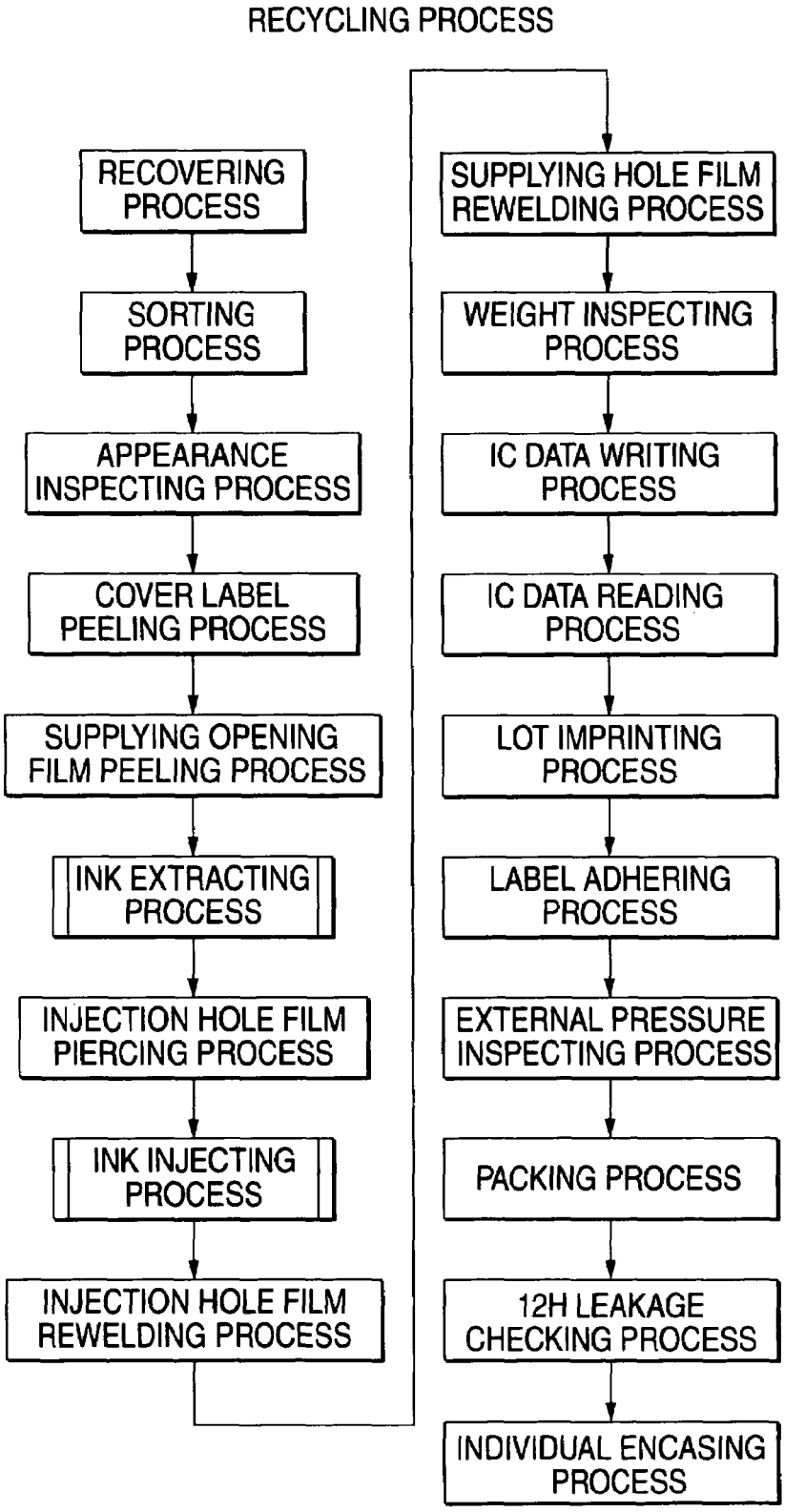
FIG. 1 is a flow chart illustrating a recycling process of a used cartridge.

FIG. 1 is a flow chart illustrating all processes of a recycling process, through which ink (ink for refilling) is injected into the used cartridge 1 in order to reuse the cartridge 1.

As illustrated in FIG. 1, in the recycling process of the cartridge 1, a 'recovering process', in which the cartridge 1 is recovered; a 'sorting process', in which the cartridge 1 is sorted; an 'appearance inspecting process', in which the appearance of the cartridge 1 is inspected; and 'cover label peeling process', in which an over-sheet 59, described below is peeled, are performed in sequence.

Then, a 'supplying hole film peeling process', in which a supplying hole film that seals an ink supply opening, described below, is peeled; an 'ink extracting process', in which ink remaining in the used cartridge 1 (remaining ink) is extracted; an 'injection hole film piercing process', in which a hole is formed in an injection hole film F of an air discharge opening 21, described below; and an 'ink injecting process', in which ink for refilling is injected into the cartridge 1, are performed in sequence.

After that, an 'injection hole film rewelding process', in which a different injection hole film 90, described below, is rewelded after the hole is formed in the film F; a 'supplying hole film rewelding process', in which a supplying hole film is rewelded; a 'weight inspecting process', in which the weight of the cartridge 1 is inspected; an 'IC data writing process', in which information is written in an IC chip 49, described below; and 'IC data reading process', in which the information of the IC chip 49 is read, are performed in sequence.

Then, a 'lot number imprinting process', in which lot numbers are imprinted on the cartridge 1; a 'label adhering process', in which a label is adhered to the cartridge 1; an 'external pressure inspecting process', in which an external pressure inspection is performed on the cartridge 1; a 'packing process', in which the cartridge 1 is reduced in pressured and packed; a '12 h leakage checking process', in which the leakage of ink or air from the cartridge 1 is checked; and an 'individual encasing process', in which the cartridge 1 is encased, are performed in sequence. The detailed description on each process will be followed.

Hereinafter, the cartridge 1 of the embodiment will be described in detail with reference to FIGS. 2 to 11.

Figure 2:
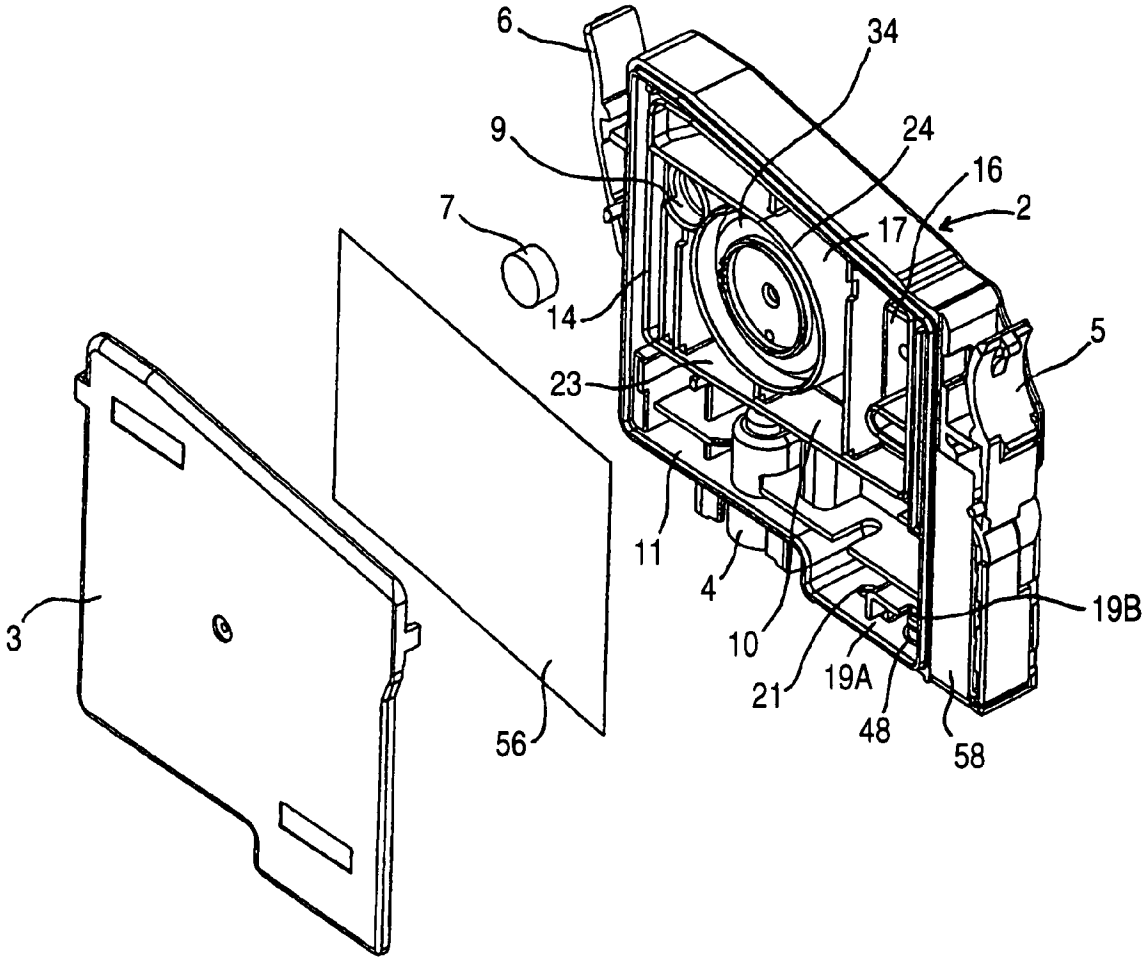
FIG. 2 is an exploded perspective view showing an embodiment of the cartridge of the present invention.
Figure 3:
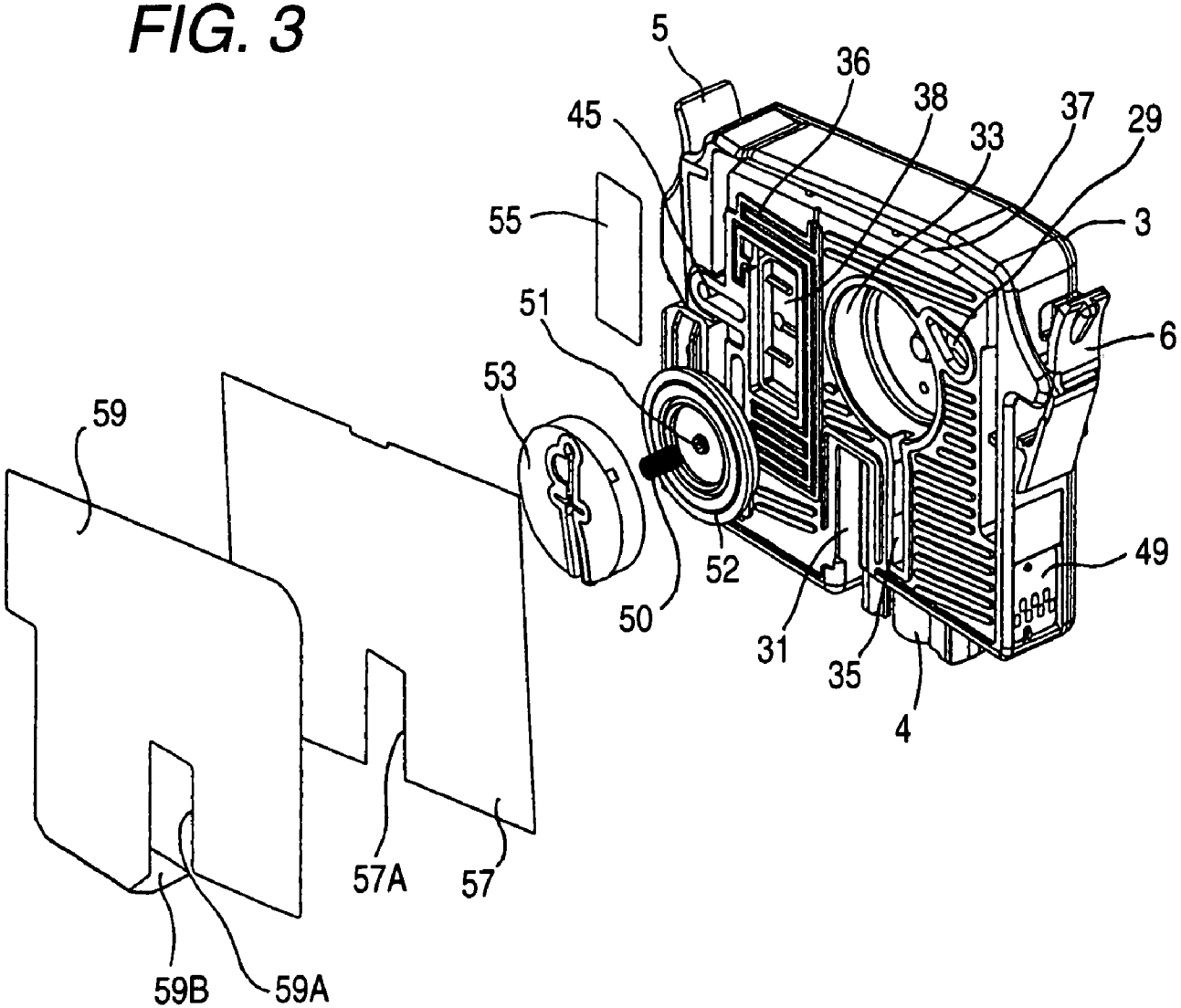
FIG. 3 is an exploded perspective view showing the cartridge.
Figure 4:
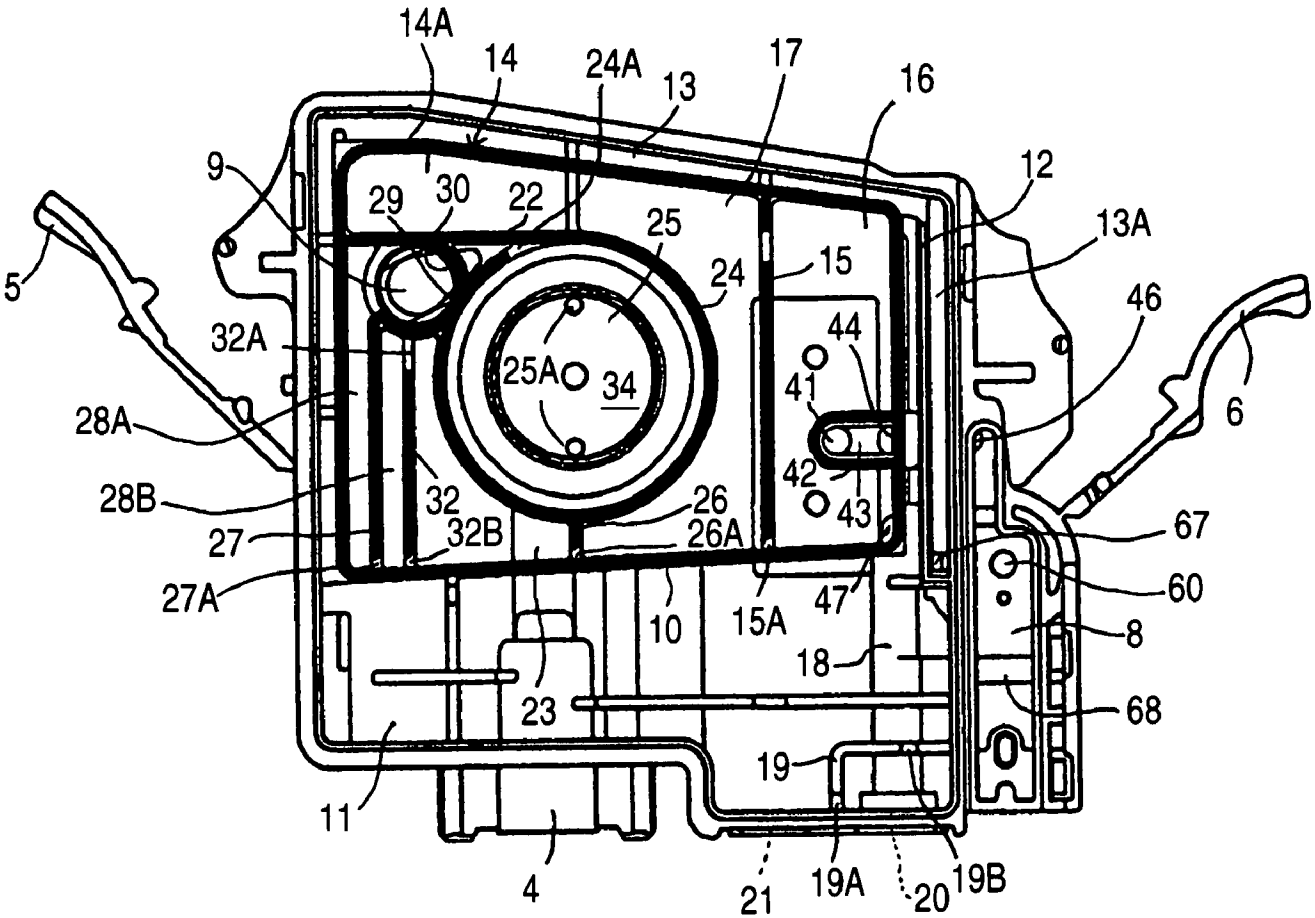
FIG. 4 is a view showing an opening of a container body.
Figure 5:
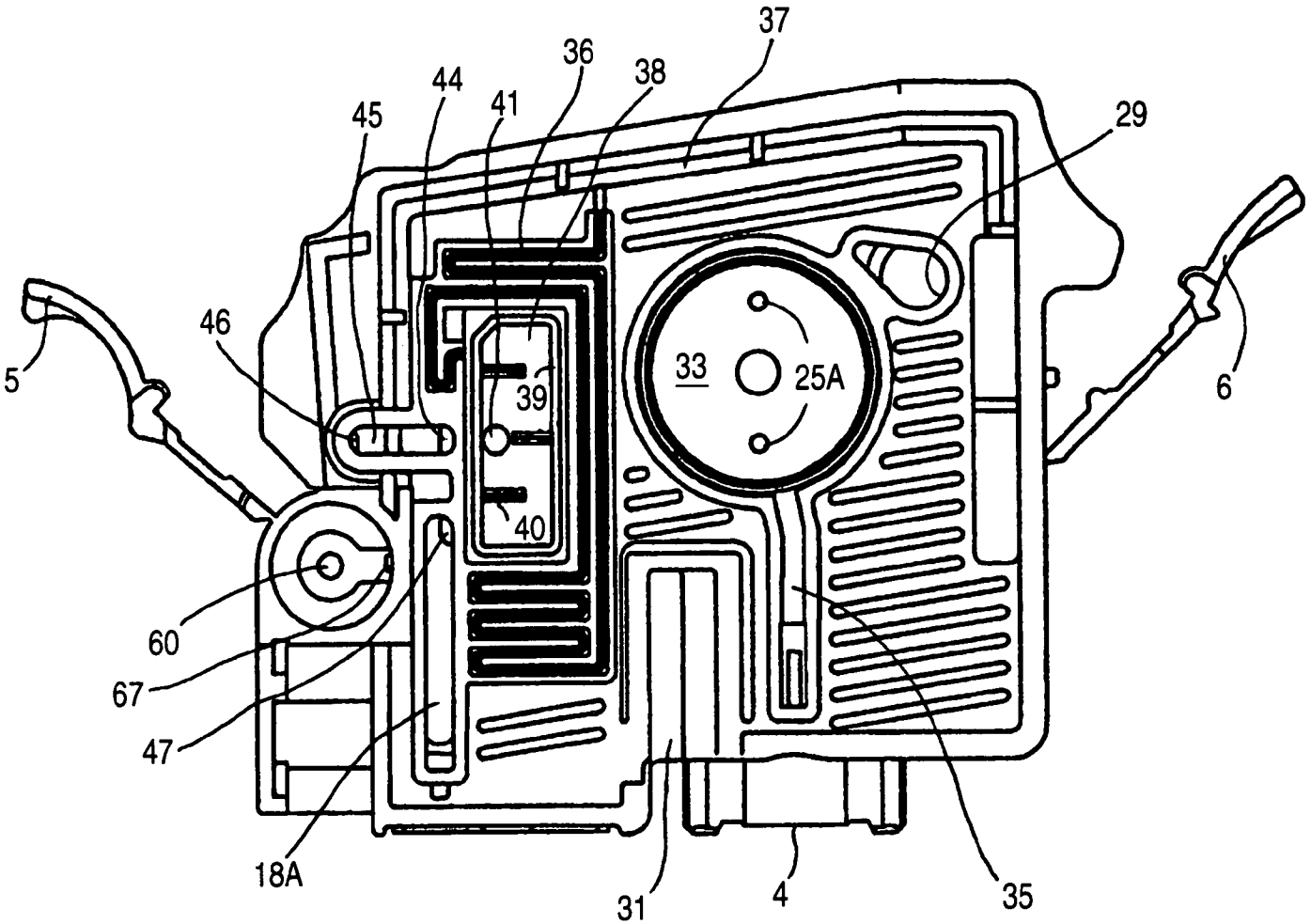
FIG. 5 is a view showing a surface of the container body.

FIGS. 2 and 3 are exploded perspective views showing an example of the cartridge 1 according to the embodiment. In addition, FIG. 4 shows a container body 2 as viewed from the opening, and FIG. 5 shows the container body 2 as viewed from a surface (hereinafter a surface of the container body 2 opposite to the opening is referred to as the 'surface of the container body 2').

The cartridge 1 has the flat and oblong container body 2, a surface of which (a left surface in FIG. 2) is open, and a lid member 3 that is welded to and seals the opening. Both of the container body 2 and the lid member 3 are made of a synthetic resin.

The container body 2 includes ink grooves 35 and 18A formed in the surface thereof, which act as ink flow passages, and an atmosphere communication groove 36, which acts as an atmosphere communication passage. In addition, since a sheet of a first film 57 having an air-tightness is welded to the surface of the container body 2, the openings of the ink grooves 35 and 18A and the atmosphere communication groove 36 are sealed, and thereby the ink grooves 35 and 18A are formed in the ink flow passage, and the atmosphere communication groove 36 is formed in the atmosphere communication passage.

As a result, since the flow passages are formed in the cartridge I by sealing the openings of the ink groove 35, the atmosphere communication groove 36 or the like formed in the surface of the cartridge with the first film 5, a container having relatively complicated flow passages, such as ink flow passages and atmosphere communication passages, can be easily formed. Therefore, a molding tool can be designed or processed-easily, which leads to a low manufacturing cost.

Hereinafter, the structure of the flow passages of the container body 2 will be described in detail.

An ink supply opening 4 is formed at a front end surface (bottom surface in the example) of the container body 2, from which the container body 2 is inserted into the carriage, and grasping arms 5 and 6, which are grasped by a hand when the cartridge 1 is attached and detached, are integrally formed with the container body 2 at the front and rear surfaces (left and right in FIG. 4) of the cartridge 1. The ink supply opening 4 accommodates a valve body (not shown), which is opened by inserting an ink supplying needle thereinto. Meanwhile, in FIG. 3, reference numeral 49 denotes an IC chip that acts as a storage unit provided below the grasping arm 6 on the side of the ink supplying hole 4.

The IC chip 49 stores information such as the amount of used ink in the cartridge 1, the amount of ink remaining in the cartridge 1, and recycling information, described below. These kinds of information are written by the information writing unit (for example, an IC checker, described below, or the like).

A frame-like portion 14 including a wall 10 extending almost horizontal, that is, slightly inclined downward toward the ink supply opening 4 is formed inside the opening of the container body 2. The frame-like portion 14 is formed with almost fixed spacing from the top and both side surfaces of the container body 2. A first ink chamber 11 that accommodates ink is formed in a region below the frame-like portion 14.

In addition, atmosphere communication passages 13 and 13A that communicate the first ink chamber 11 with atmosphere through a through-hole 67 are formed by a gap formed between the frame-like portion 14 and an outer circumferential wall of the container body 2 and by a wall 12 of the frame-like chamber 14 provided at a valve accommodating chamber 8.

The lid member 3 is welded to the wall 12 and the outer circumferential wall of the container body 2 so as to form the atmosphere communication passage 13A. In addition, an upper end of the wall 12 forming the atmosphere communication passage 13A extends up to almost the top of the container body 2 to make the upper end protrude higher than the liquid surface in the first ink chamber 11 when the cartridge 1 is used. As a result, the opening of the atmosphere communication passage 13A is located higher than the liquid surface in the first ink-chamber 11, so that flow of the ink back to the through-hole 67 is prevented as much as possible.

The interior of the frame-like portion 14 is divided into right and left regions by a wall 15 having a communication opening 15A, through which ink flows, at the bottom and extending in the longitudinal direction. In addition, a second ink chamber 16 that temporarily reserves the ink lifted from the first ink chamber 11 is formed at the right region of the frame-like portion 14 divided by the wall 15. Furthermore, in the left region, a third ink chamber 17, a fourth ink chamber 23, a fifth ink chamber 34 or the like are formed, and a differential pressure valve composed of a membrane valve 52, a spring 50 and the like is accommodated.

The differential pressure valve is a pressure control valve that controls the pressure of supply of the ink with respect to the ink supply opening 4 and provided to hold the ink in the cartridge 1 by the pressure control of the pressure control valve. As such, the cartridge 1 of the embodiment includes the pressure control valve that controls the pressure of supply of the ink with respect to the ink supply opening 4 and holds the ink therein by the pressure control of the pressure control valve. When this type of cartridge is used, the ink can move smoothly in the cartridge 1, and therefore, the ink can be refilled easily, and the effect of the invention improves remarkably.

In the portion of the first ink chamber 11 below the second ink chamber 16, the second ink chamber 16 is communicated with the bottom surface of the container body 2 so as to form a liquid lifting passage 18 that lifts the ink from the first ink chamber 11 to the second ink chamber 16. An oblong region surrounded by a wall 19 is formed in the lower portion of the lifting passage 18, and communication openings 19A and 19B are formed at the lower portion and top surface of the wall 19.

The lifting passage 18 forms a groove-like ink groove 18A in the surface of the container body 2, and the ink groove 18A is sealed by the first film 57.

In addition, the lifting passage 18 communicates with the second ink chamber 16 at its upper portion through the communication opening 47, and its lower end opening 18B (see FIG. 9) communicates with the first ink chamber 11 through an opening 48 formed in the oblong region surrounded by the lower wall 19. As a result, the first ink chamber 11 communicates with the second ink chamber 16 through the lifting passage 18, and the ink is introduced into the second ink chamber 16 from the first ink chamber 11.

Furthermore, an ink injection opening 20, which is used when the ink is injected into the first ink chamber 11, is formed in a portion of the bottom surface of the container body 2 corresponding to the lifting passage 18. Still furthermore, an air discharge opening 21 that discharges air during the injection of the ink is formed in the vicinity of the ink injection opening 20.

The air discharge opening 21, which forms a second opening separately from the ink supply opening 4, communicates with the first ink chamber 11, which is an ink reservoir chamber upstream of the differential pressure valve. In the embodiment, ink is injected from the air discharge opening 21 in 'the ink injecting process'. That is, when ink is injected into a brand new cartridge, ink is injected from the ink injection opening 20, and when ink is injected into a used cartridge, ink is injected from the air discharge opening 21. In the embodiment, 18.18 grams (g) of ink is filled in an unused cartridge.

In the third ink chamber 17, a wall 22 is formed to extend horizontally with a predetermined spacing apart from the upper surface 14A of the frame-like portion 14. In addition, the third chamber 17 is partitioned by a circular-arc wall 24 communicating with the wall 22, and a differential pressure valve accommodating chamber 33 and the fifth ink chamber 34 are formed in a portion surrounded by the wall 24.

The region surrounded by the circular-arc wall 24 is divided into two parts in the thickness direction by a wall 25 in order to form the differential pressure valve 33 at a surface facing the fifth ink chamber 34. An ink circulation opening 25A is provided in the wall 25 in order to introduce the ink flowed into the fifth ink chamber 34 into the differential pressure valve accommodating chamber 33.

A partition wall 26 including a communication opening 26A between the wall 10 and itself is formed at the lower portion of the substantially circular-arc wall 24, and a portion below the partition wall 26 (left portion in FIG. 4) forms the fourth ink chamber 23. In addition, a partition wall 27 having the communication opening 27 and extending in the longitudinal direction; and a partition wall 32 having communication openings 32A and 32B at the top and bottom and extending in the longitudinal direction are provided at the lower portion between the circular-arc wall 24 and the frame-like portion 14 so as to form the ink flow passages 28A and 28B.

Furthermore, a circular-arc wall 30 is formed at the container body 2 in order to continue to the upper end of the partition wall 27 and to connect with the substantially circular-arc wall 24 and the wall 22. Still furthermore, a region surrounded by the circular-arc wall 30 is formed at a filter accommodating chamber 9, in which a block-shaped (cylindrical in the example) filter 7 is accommodated.

Still furthermore, a through-hole 29 that couples a large circle and a small circle is formed in the circular-arc wall 30 that forms the filter accommodating chamber 9. Still furthermore, the through-hole 29 of the large circle side communicates with the upper portion of the ink flow passage 28A, and the through-hole 29 of the small circle side communicates with the upper portion of the fifth ink chamber 34 through the communication opening 24A provided at the front end of the substantially circular-arc wall 24. As a result, the ink flow passage 28A communicates with the fifth ink chamber 34 through the through-hole 29.

Still furthermore, the ink flowed into the ink flow passage 28A through the communication openings 15A, 26A, 32B, 27A or the like from the second ink chamber 16 is filtered by the filter 7 in the filter accommodating chamber 9 and flows into the large circle side of the through-hole 29. Then, the ink flowed into the through-hole 29 flows into the fifth ink chamber 34 from the small circle side of the through-hole 29 through the communication opening 24A. The opening of the through-hole 29 on the side of the surface of the container body 2 is sealed by the first film 57.

Here, the airtight second film 56 is welded to the opening of the frame-like portion 14. That is, the second film 56 is welded to the frame-like portion 14, the walls 10, 15, 22, 24, 30, 42 and the partition walls 26, 27, 32 so as to form the ink chambers or the flow passages.

Meanwhile, the ink supply opening 4 is communicated with the lower portion of the differential pressure valve accommodating chamber 33 by the ink groove 35 formed at the surface and the flow passage made of the airtight first film 57 that covers the ink groove 35. The upper and lower ends of the ink groove 35 are communicated with the differential pressure valve accommodating chamber 33 and the ink supply opening 4, respectively. As a result, the ink flowed into the fifth ink chamber 34 passes through the ink circulation opening 25A and the differential pressure valve accommodating chamber 33, and flows into the ink supply opening 4 from the flow passage formed with the ink groove 35.

In addition, in the surface of the container body 2, the atmosphere communication groove 36 that meanders to increase the flow passage resistance as much as possible; and a wide groove 37 that communicates with the atmosphere communication groove 36 and surrounds the differential pressure valve accommodating chamber 33 and the atmosphere communication groove 36 are formed. Furthermore, an oblong recessed portion 38 is formed in a region of the surface of the container body 2 corresponding to the second ink chamber 16.

A frame portion 39 and a rib 40 are formed a step deeper in the oblong recessed portion 38. Furthermore, the oblong recessed portion 38 is formed in an atmosphere ventilation chamber that communicates with atmosphere through the atmosphere communication groove 36 and the groove 37 by spreading an airtight sheet 55 having an ink-repellant property on the frame portion 39 and the rib 40.

A through-hole 41 is bored at the rear surface of the recessed portion 38 and communicated with an elongated region 43 divided by an oval wall 42 in the second ink chamber 16. In addition, the atmosphere communication groove 36 communicates with a region of the recessed portion 38 closer to the surface than the air-permeable sheet 55. Furthermore, a through-hole 44 is bored in an end of the elongated region 43 opposite to the through-hole 41. The through-hole 44 is communicated with a communicating groove 45 formed on the side of the surface of the container body 2 and a valve accommodating chamber 8, which is an atmosphere opening valve chamber, through a through-hole 46 that is bored to communicate with the groove 45.

In the valve accommodating chamber 8, a through-hole 60 that communicates with a through-hole 67 formed in the atmosphere communication passage 13A formed in the first ink chamber 11 is formed. As a result, the air flowed into the recessed portion 38 through the atmosphere communication groove 36 and the groove 37 reaches the valve accommodating chamber 8 through the through-hole 41, the elongated region 43, the through-holes 44, 46, and reaches the first ink chamber 11 from the valve accommodating chamber 8 through the through-hole 60, the through-hole 67, and the atmosphere communication passage 13, 13A.

In addition, the valve accommodating chamber 8 is open at the side where the cartridge is inserted (bottom surface in the example), whereby, as described below, an identifying piece or operating rod provided at a main body of a recording device can be inserted into the valve accommodating chamber 8, and an atmosphere opening valve, which is opened by inserting the operating rod into the upper portion and keeps it open at all time, is accommodated.

Figure 6:
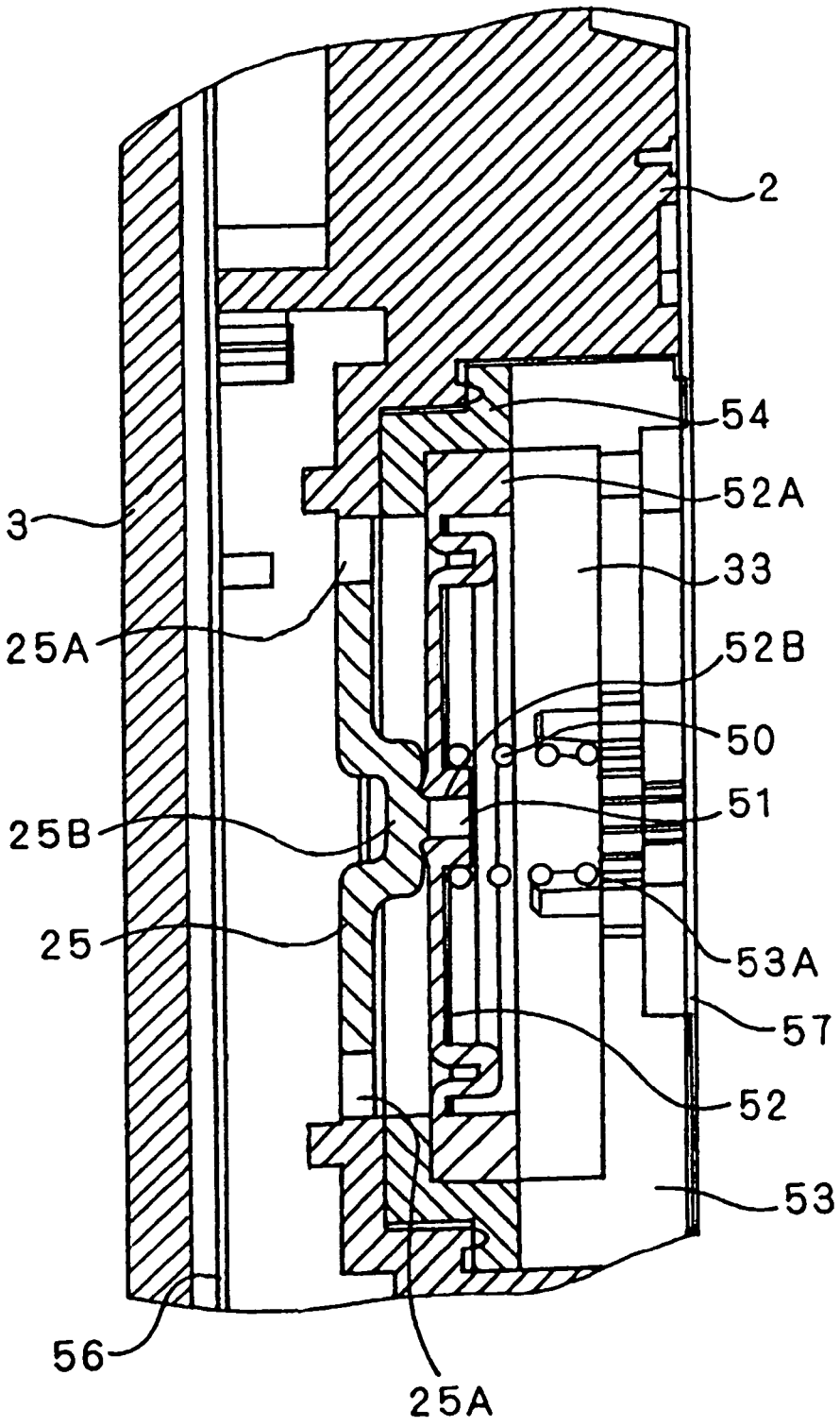
FIG. 6 is a view showing an enlarged cross-sectional structure of a differential pressure regulating valve accommodating chamber.

FIG. 6 shows a sectional structure of portions around the fifth ink chamber 34 and the differential pressure valve accommodating chamber 33. Meanwhile, the surface of the container body 2, at which the differential pressure valve accommodating chamber 33 is placed, is located at the right of the drawing. A membrane valve 52 composed of a spring 50 and an elastically deformable material, such as elastomer, and having a through-hole 51 in its center is accommodated. The-membrane valve 52 includes an annular thick portion 52A there around and is fixed to the container body 2 through a frame portion 54 integrally formed with the thick portion 52A. Furthermore, the spring 50 is supported such that one end thereof abuts against a spring receiving portion 52B of the membrane valve 52*d* and the other end thereof abuts against a spring receiving portion 53A of a lid member 53 that covers the differential pressure accommodating chamber 33.

With the above configuration, the flow of the ink passing through the ink circulation opening 25A from the fifth ink chamber 34 is blocked by the membrane valve 52. If the pressure of the ink supply opening 4 is lowered in this state, the membrane valve 52 disengages from a valve seating portion 25B due to the negative pressure against the urging force of the spring 50. In this case, the ink passes through the through-hole 51 and the flow passage formed with the ink groove 35, and flows into the ink supply opening 4.

When the pressure of the ink supply opening 4 reaches a predetermined value, the membrane valve 52 is made elastically contact the valve seating portion 25B by the urging force of the spring 50, and thus the flow of the ink is blocked. Therefore, the ink can be discharged from the ink supply opening 4 by repeatedly performing the above operation while the pressure of the ink supply opening 4 remains at a fixed negative pressure.

Figure 7:
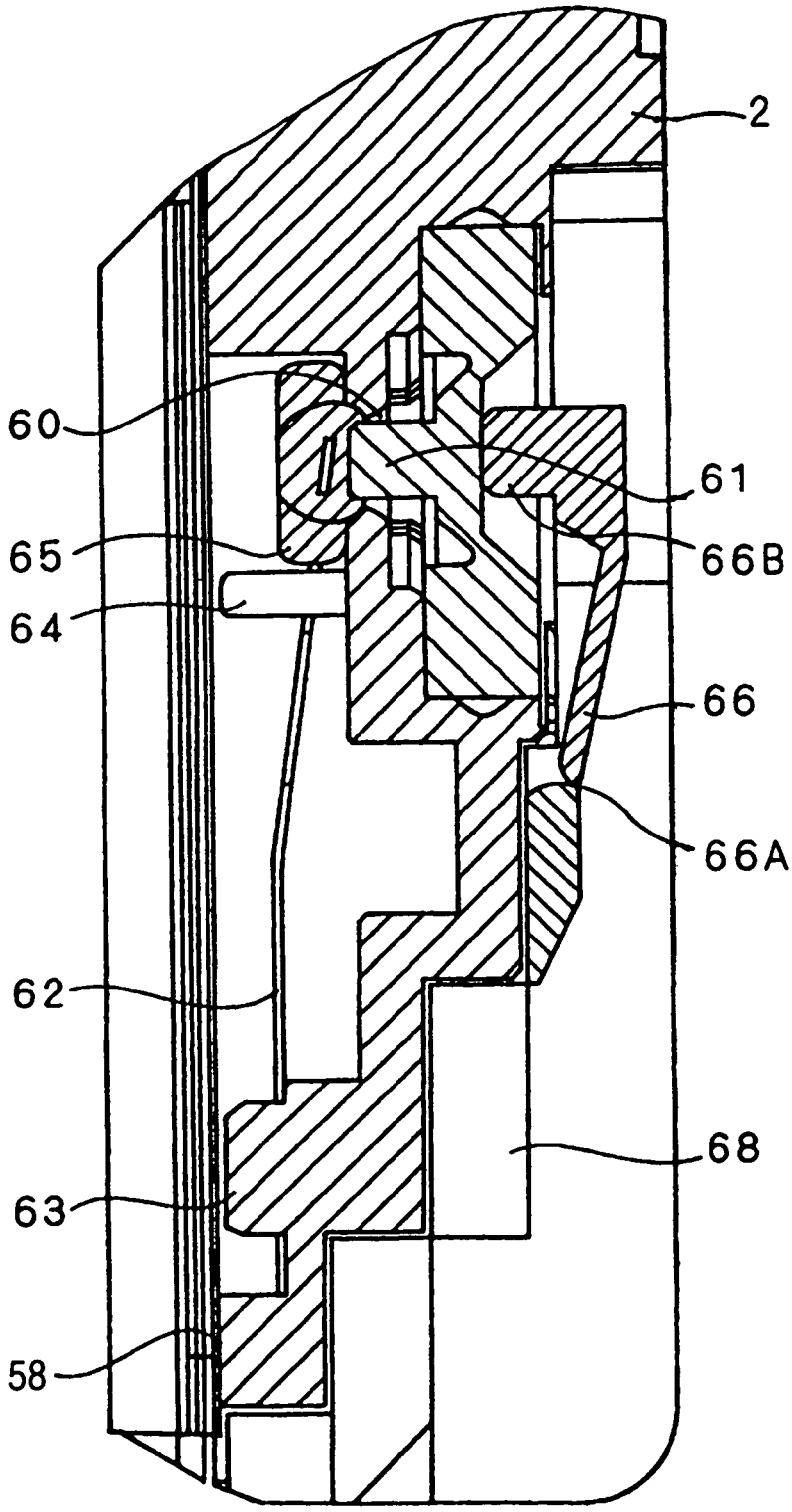
FIG. 7 is a view showing an enlarged cross-sectional structure of a valve accommodating chamber.

FIG. 7 shows a sectional structure of the valve accommodating chamber 8 for atmosphere communication. Meanwhile, the surface of the container body 2 is placed at the right of the drawing. A through-hole 60 is bored in a wall dividing the valve accommodating chamber 8, and a pressing member 61 including an elastic member, such as rubber, is movably inserted into the surface of the container body 2 while the surrounding of the pressing member 61 is supported by the container body 2. A valve body 65 supported by an elastic member 62 and urged to the through-hole 60 at all times is disposed at the front end of the pressing member 61 (in the advancing direction). As the elastic member 62, a leaf spring having its lower end fixed by a protrusion 63 and its middle portion regulated by a protrusion 64 is used in the example.

On the other hand, an arm 66 is disposed opposite to the pressing member 61. A portion (a lower end in the example) of the arm 66 in the direction that the cartridge 1 is inserted, is fixed to the container body 2, through a turning fulcrum 66A located inside an operating rod 70, described below. In addition, a pullout portion (a top portion in the example) of the arm 66 protrudes obliquely with respect to an entering passage of the operating rod 70. A prominent portion 66B that elastically presses the pressing member 61 is formed at the front end of the arm 66. With the above configuration, as described above, the through-hole 67 is connected with the atmosphere communicating recessed portion 38 through the through-hole 60, the valve accommodating chamber 8, the through-hole 46, the groove 45, the through-hole 44, the elongated region 43, and the through-hole 41 when the valve body 65 is opened.

In addition, the identifying prominent portion 68 is provided on a portion of the valve accommodating chamber 8 closer to the portion, through which the cartridge is inserted, than the arm 66 (bottom in the example) in order to determine whether the cartridge 1 is compatible with the recording device. The identifying prominent portion 68 is provided at allocation, at which the determination can be performed by the identifying piece (operating rod) 70A, before the ink supply opening 4 is communicated with an ink supplying needle 72 (see FIG. 8), and the valve body 65 is opened.

Figure 8:
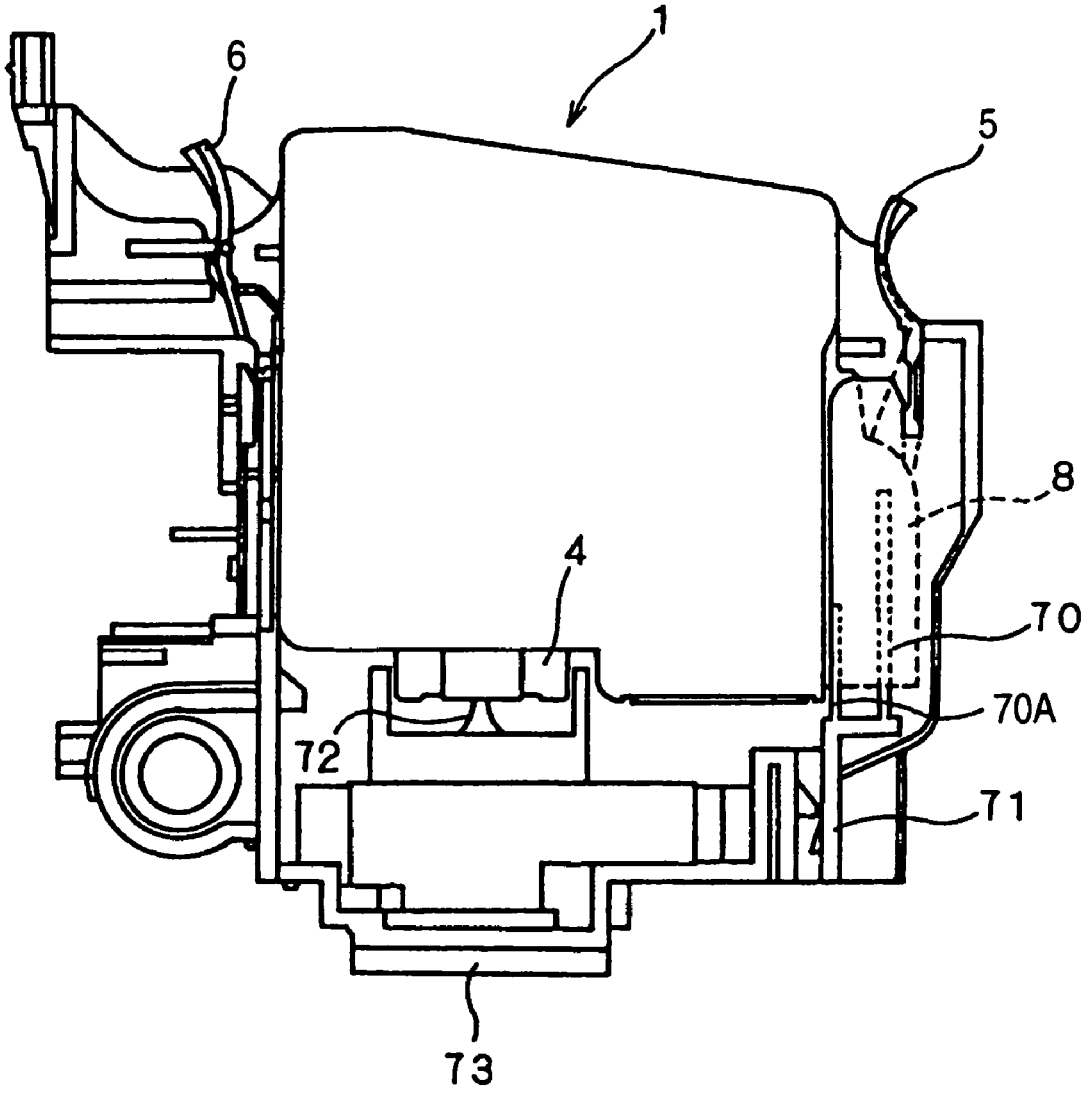
FIG. 8 is a view showing an example of a cartridge holder.

With the above configuration, if the cartridge 1 is mounted on a cartridge holder 71 having the operating rod 70 standing at the lower surface as shown in FIG. 8, the operating rod 70 abuts against the oblique arm 66, and the pressing member 61 is inclined to the valve body 65 when the cartridge 1 is pushed in. As a result, the valve body 65 is disengaged from the through-hole 60 and opens the atmosphere-communicating recessed portion 38 to the atmosphere through the through-hole 46, the groove 45, the through-hole 44, the region 43, and the through-hole 41, as described above.

Furthermore, when the cartridge 1 is pulled out of the cartridge holder 71, the operating rod 70 no longer supports the arm 66, and thereby the valve body 65 seals the through-hole 60 by the urging force of the elastic member 62, and the ink accommodating portion is blocked from the atmosphere.

Next, the airtight first film 57 is adhered to the surface in order to cover at least a region where the recessed portion is formed in a state that all members, such as valves, are incorporated into-in the container body 2. As a result, a capillary forming the atmosphere communication passage by the recessed portion and the first film 57 is formed at the surface.

Here, the disposition of the flow passages including the capillary or the forming of the flow passage will be described in detail.

Figure 9:
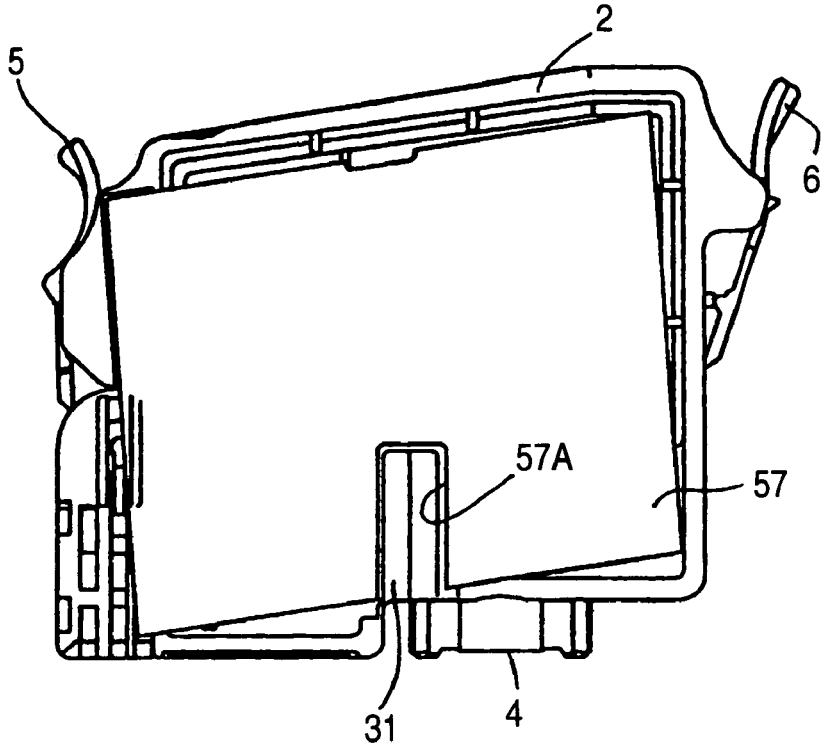
FIG. 9 is a view showing a welded first film.
Figure 9:
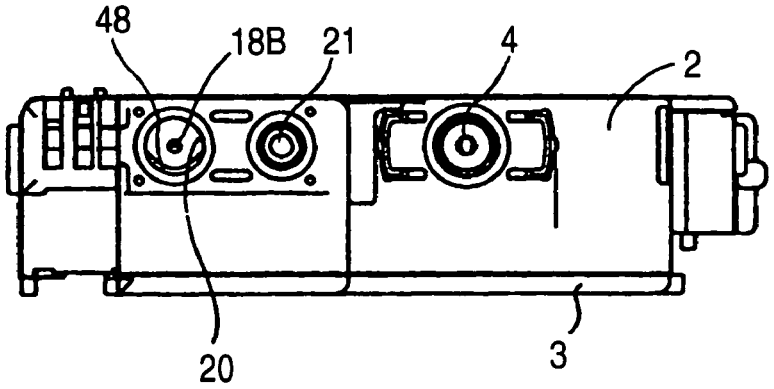

As described above, in the cartridge 1, the openings of the ink groove 35, the through-hole 29, the ink groove 18A, the groove 45, the atmosphere communication groove 36 and the recessed portion 38 are sealed by welding a sheet of the first film 57 to the surface of the container body 2. The ink groove 35, the through-hole 29, the ink groove 18A and the groove 45 are formed in the ink passage respectively, and the atmosphere communication groove 36 and the recessed portion 38 are formed in the atmosphere communication passage respectively. FIG. 9 shows the cartridge 1, to which the first film 57 is welded.

In this case, the first film 57 is coated on the surface of the container body 2 and then pressed by a heated pressing plate for thermal welding.

Here, the atmosphere communication groove 36 is a fine and shallow groove that is curved complicatedly in order to prevent the evaporation of the ink, as much as possible, and the excessive increase in the passage resistance. Therefore, when the atmosphere communication groove 36 is sealed by the first film 57, the atmosphere communication groove 36 can be crushed and thus the air circulation can be interrupted if the welding height is not managed with a high precision. Meanwhile, it is desirable that the recessed portion forming the ink passage of the ink groove 35 or the like be welded with a careful attention to the welding strength in order to prevent the ink leakage.

Figure 10:
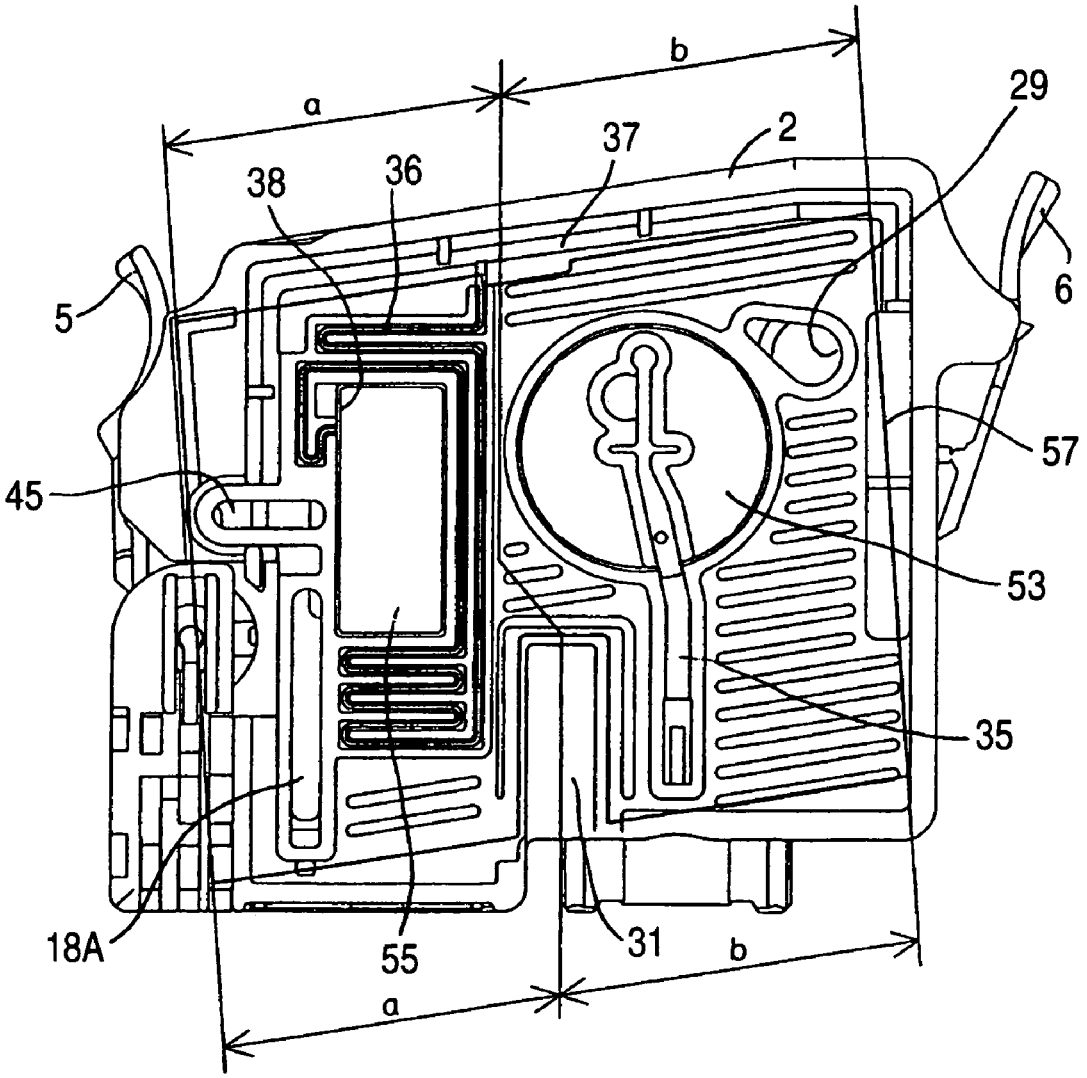
FIG. 10 is a view explaining about the disposition of flow passages of the cartridge according to the invention.

In addition, as shown in FIG. 10, a flow passage is disposed to divide the surface of the container body 2 into two regions, that is, a region (a) where a recessed portion forming the ink flow passage is formed, while the ink groove 35, the through-hole 29 or the like occupies much of them, and a region (b) where the atmosphere communication groove 36 is formed. Furthermore, the groove 31 that does not forms the ink flow passage is formed at a border portion between the regions (a) and (b) on the surface of the container body 2.

Still furthermore, a range where the first film 57 is pressed by the heated pressing plate at a time when it is welded to the container body 2 (hereinafter referred to as 'welding range') is divided into a region (a) where the precision of the welding height needs to be managed, and a region (b) where the welding strength needs to be managed, so that the welding conditions are independently controlled in the regions (a) and (b). As a result, since both of the welding precision and the welding strength can be managed, and the welding precision and the welding strength can be managed better if the welding state on a relatively narrow portion is controlled, the welding conditions can be extracted easily.

Still furthermore, the welding range of the first film 57 is divided into a region (b) where the ink groove 35 forming the ink flow passage downstream of the differential pressure valve that generates negative pressure in the cartridge 1 is formed, and a region (a). That is, since the shape of the flow passages, such as the ink flow passage and the atmosphere communication passage, is relatively complicated, complicated flow passages can be formed easily in the cartridge 1 having the differential pressure valve.

Still furthermore, since the groove 31 that does not form the flow passage is placed at the border portion between the divided welding ranges (a) and (b), a welding and pressing surface, to which the first film 57 is welded, can be overlapped between the divided welding ranges (a) and (b), and thereby the degree of freedom in designing a welding device improves. In FIG. 9, reference numeral 57A denotes a cutout portion provided at a portion of the first film 57 corresponding to the groove 31.

Figure 11:
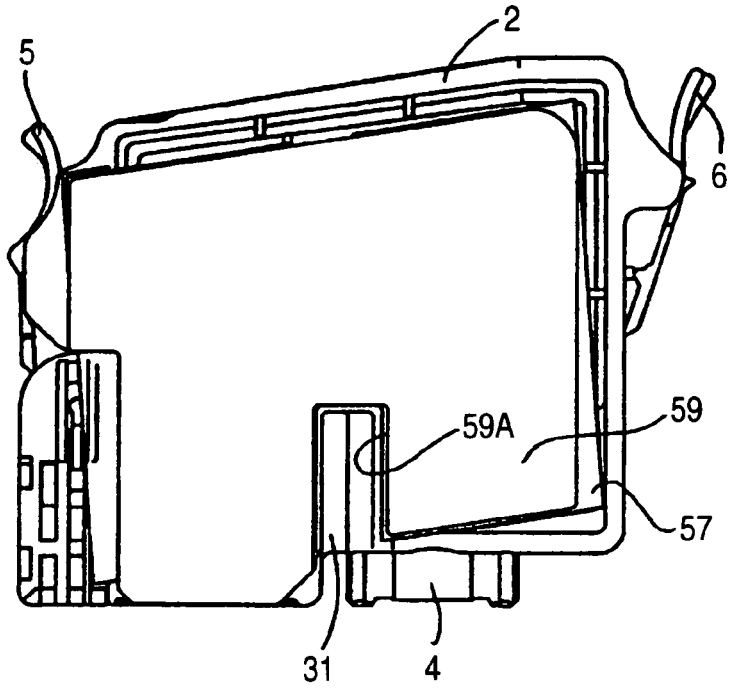
FIG. 11 is a view showing a welded over-sheet.
Figure 11:
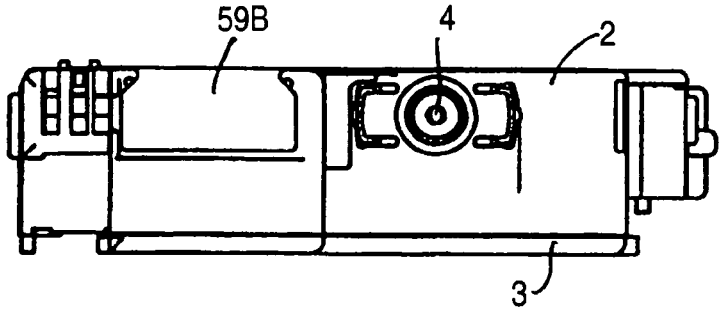

As shown in FIG. 11, the cartridge 1 has an over-sheet 59 that covers the first film 57 adhered to the surface of the container body 2. As a result, the first film 57 is protected by the over-sheet 59, and the ink leakage due to the damage of the first film 57 and the evaporation of the ink can be decreased. In the drawing, reference numeral 59A denotes a cutout portion provided in a portion of the over-sheet 59 corresponding to the groove 31.

The over-sheet 59 is thicker than the first film 57. That is, in the cartridge 1, the first film 57 is thinner than the over-sheet 59. As a result, when the ink groove 35, 18A, the atmosphere communication groove 36 and the like are sealed by welding the first film 57, since the first film 57 can cover the surface of the container body 2 easily, the welding strength or the welding precision improves well. Furthermore, the first film 57 can be protected effectively by the relatively thick over-sheet 59.

Still furthermore, the over-sheet 59 has an extending region 59B that covers the lower surface of the container body 2, and the extending region 59B covers the ink injection opening 20 and the air discharge opening 21. As described above, a sheet of over-sheet 59 can cover the ink injection opening 20 and the air discharge opening 21, and thereby the process can be simplified or the number of parts can be reduced.

Meanwhile, the opening of the container body 2 is adhered with the airtight second film 56 by thermal welding or the like in order to make the container body 2 airtight with respect to the frame-like portion 14, the walls 10, 15, 22, 24, 30, 42, and the partition walls 26, 27, 32. In addition, the lid member 3 is put on and fixed to the opening by welding or the like. As a result, the regions divided by the respective walls are sealed to communicate with one another only through the communication opening or the opening.

Furthermore, the opening of the valve accommodating chamber is also sealed with the airtight third film 58 by the thermal welding or the like, thereby finishing the cartridge 1. If the ink accommodating portions are sealed by the airtight first and second films 56 and 57 or the like as described above, the container body 2 can be molded easily, and the vibration of the ink resulting from the reciprocating motion of the cartridge can be absorbed by the deformation of the first and second films 56 and 57, and thereby the ink pressure can be kept constant.

After that, an ink injection pipe is inserted into the ink injection opening 20, and then sufficiently degassed ink is injected in a state where the air discharge opening 21 is opened. After the injection is completed, the ink injection opening 20 and the air discharge opening 21 are sealed by an injection hole film F and the over-sheet 59.

Since the cartridge 1 having the above configuration is blocked from the atmosphere by the valve or the like, the degassed rate of the ink can be maintained sufficiently.

In addition, when the cartridge 1 is mounted to the cartridge holder 71, if the-right cartridge 1 is mounted to the cartridge holder 71, the cartridge 1 enters the cartridge holder to a position where the ink supply opening 4 is inserted into the ink supplying needle 72, and the through-hole 60 is made open by the operating rod 70 as described above, whereby the ink accommodating portion communicates with the atmosphere, and the valve of the ink supply opening 4 is also made open by the ink supplying needle 72.

Meanwhile, when the wrong cartridge 1 is mounted to the cartridge holder 71, the identifying prominent portion 68 abuts against the identifying piece 70A of the cartridge holder 71 before the ink supply opening 4 reaches the ink supplying needle 72, and thereby the cartridge 1 cannot enter any longer. In the above state, since the operating rod 70 also cannot reach the arm 66, the valve body 65 remains in a sealing state, and the ink accommodating portion does not open to the atmosphere, and thereby the evaporation of the ink can be prevented.

If the right cartridge 1 is mounted to the cartridge holder 71, and the ink is consumed by the recording head during printing, since the pressure of the ink supply opening 4 is lowered to a prescribed pressure or less, the membrane valve 52 is made open as described above. In addition, if the pressure of the ink supply opening 4 increases, the membrane valve 52 is closed. With the above operation, the ink maintained at a predetermined negative pressure flows into the recording head.

If the ink is consumed in the recording head, the ink in the first ink chamber 11 flows into the second ink chamber 16 through the lifting passage 18. Air bubbles flowed into the second ink chamber 16 moves up due to the buoyant force, and only ink flows into the third ink chamber 17 through the communication opening 15A at the lower portion.

The ink in the third ink chamber 17 passes through the communication opening 26A of the partition wall 26 formed at the lower end of a substantially circularly-formed wall 24 and the fourth ink chamber 23 and flows into the ink flow passages 28A and 28B.

The ink flowed through the ink flow passage 28A flows into the filter accommodating chamber 9 and then filtered by the filter 7. The ink passed through the filter accommodating chamber 9 flows from the large circle side to the small circle side of the through-hole 29, and then flows into the upper portion of the fifth ink chamber 34 through the communication opening 24A.

After that, the ink flowed into the fifth ink chamber 34 flows into the differential pressure valve accommodating chamber 33 through the ink circulation opening 25A, and then flows into the ink supply opening 4 at a predetermined negative pressure by the opening and closing operation of the membrane valve 52 as described above.

Here, the first ink chamber 11 communicates with the atmosphere through the atmosphere communication passages 13, 13A, the through-hole 67, the valve accommodating chamber 8 and the like and is maintained at the atmospheric pressure. Therefore, negative pressure is induced, and thus the flow of the ink is not interrupted. Even when the ink in the first ink chamber 11 flows backward and reaches the recessed portion 38, the recessed portion 38 is provided with the air-permeable sheet 55 having an ink-repellant property, and thereby the air-permeable sheet 55 communicates the recessed portion 38 with the atmosphere while the discharge of the ink is interrupted. As a result, it can be prevented previously that the ink flows into the atmosphere communication groove 36 and then the atmosphere communication groove 36 is blocked by the solidification of the ink.

As described above, the cartridge 1 includes the ink groove 35 or the like or the atmosphere communication groove 36 formed in the surface of the container body 2, and the flow passages are formed by sealing the openings of the ink groove 35 or the like or the atmosphere communication groove 36 with the first film 57, and thereby the container including complicated flow passages, such as the ink flow passage and the atmosphere communication passage, can be molded easily, and the molding tool can be designed and manufactured easily. As a result, the manufacturing cost can be reduced.

Meanwhile, even though the example shows the cartridge using the columnar filter 7, the invention is not limited thereto, and various shapes and sizes of the filter 7 can be used in the cartridge 1 if the filter 7 has a block shape.

Next, the recycling process of the used cartridge will be described referring back to FIG. 1.

First, the used cartridges 1 are recovered for every type or color in 'the recovering process', and then the recovered cartridges 1 are sorted in 'the sorting process'.

In the 'sorting process', the IC checker that reads the recycling information stored in the IC chip 49 reads the recycling information stored in the IC chip 49 of the cartridge 1. The recycling information includes the manufacturing date of the cartridge, and whether the ink is extracted or not is determined by determining whether the predetermined period elapses or not from the read manufacturing date. For example, whether one and a half year elapse or not from the manufacturing date of the cartridge is determined, and if one and a half year do not elapse, ink for refilling is injected additionally in a state that the ink remains in the cartridge 1 with no 'ink extracting process'. On the other hand, if one and a half year elapse, like the example, 'the ink extracting process' is performed, and thus ink for refilling is injected after the remaining ink is extracted from the cartridge 1.

As the recycling information, the number of recycling or the like is written. In this case, the recycling information is written in 'the IC data writing process'.

Next, in 'the appearance inspecting process', the appearance of the sorted cartridge 1 is inspected. In this process, poor cartridges 1 such as a cartridge remarkably polluted by the ink due to ink leakage or the like, a cartridge having severe appearance damage such as a cartridge having no grasping arm, a cartridge having no IC chip or the like are sorted with naked eyes and removed from the recovered cartridges 1.

After that, in 'the cover label peeling process', among the over-sheet 59, the extending region 59B that covers the ink injection opening 20 and the air discharge opening 21 is peeled off from the lower surface of the container body 2. Since 'the cover label peeling process' in the present embodiment is performed prior to 'the ink extracting process', the extending region 59B of the over-sheet 59 is peeled off, while the film F is kept attached to the lower surface of the container body 2 to maintain the sealing state of the ink injection opening 20 and the air discharge opening 21. In addition, 'the cover label peeling process' may be performed after 'the ink extracting process' is performed.

Figure 12:
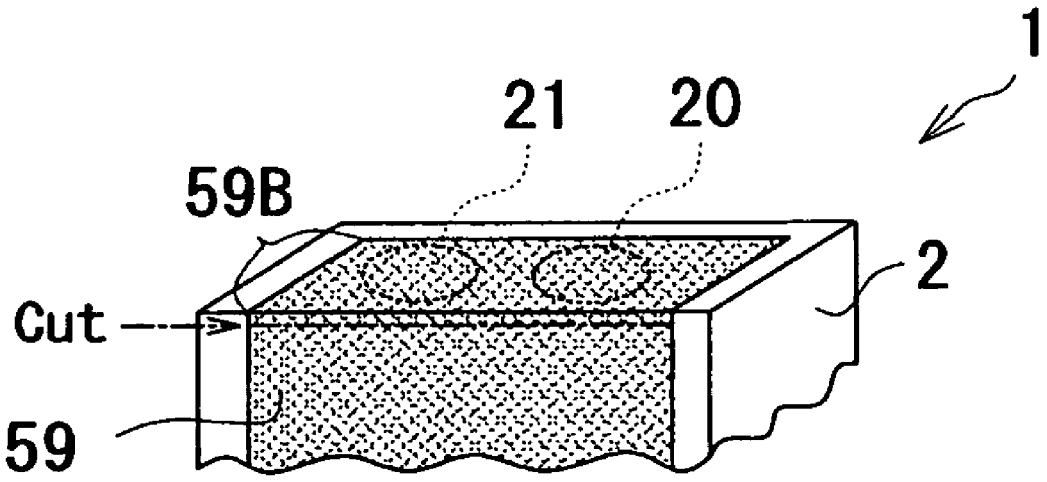
FIG. 12 is a view showing a cover label peeling process.

As shown in FIG. 12, in 'the color label peeling process', the extending region 59B is cut from the over-sheet 59 by scissors, cutter knife or the like, and then peeled off from the lower surface of the container body 2.

After that, in 'the opening hole film peeling process', a supplying opening film (not shown) that seals the ink supply opening 4 of the cartridge 1 is peeled off by tweezers or the like.

After that, in 'the ink extracting process', the ink remaining in the cartridge 1 is extracted.

Figure 13:
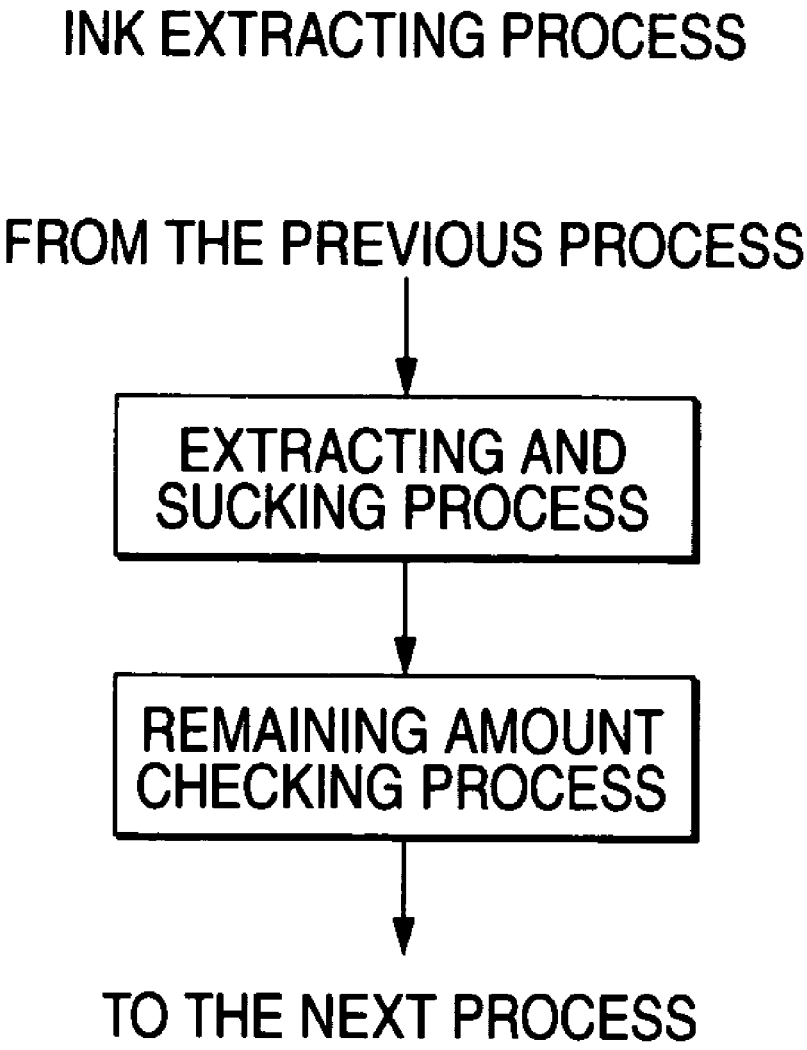
FIG. 13 is a view showing an ink extracting process.

As shown in FIG. 13, in 'the ink extracting process', an extracting and sucking process, in which the ink remaining in the used cartridge 1 is sucked and extracted, and a remaining amount checking process, in which it is checked whether the amount of the ink remaining in the cartridge 1 after the remaining ink is extracted in the extracting and sucking process occupies a predetermined ratio or less of the total amount of the ink to be refilled in a new cartridge, are performed.

Figure 14:
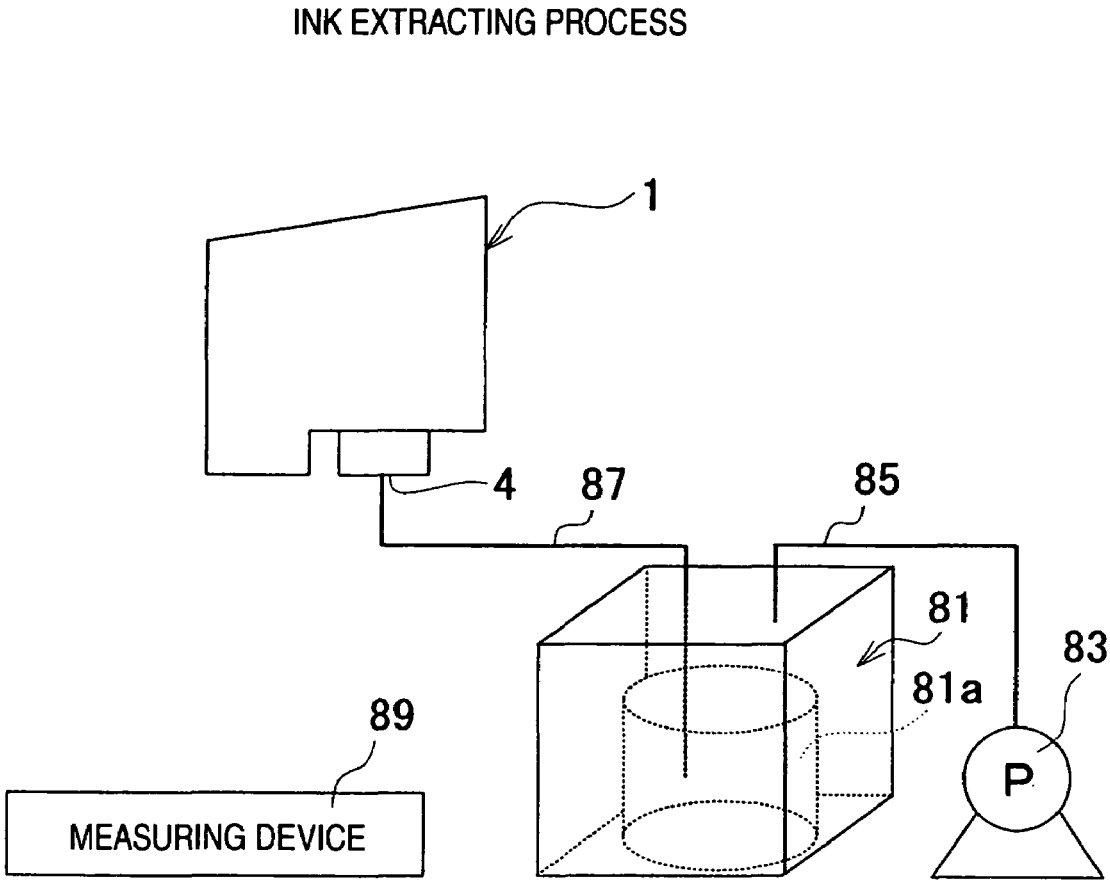
FIG. 14 is a view showing a liquid extracting unit used in the ink extracting process.

FIG. 14 shows a liquid extracting device in a liquid refilling device according to the invention that refills ink to the used cartridge 1. The device includes a liquid extracting unit, described below, that extracts the ink remaining in the cartridge 1; a measuring device 89, which is a measuring unit that measures whether the amount of the ink remaining in the cartridge 1 after the remaining ink is extracted occupies a predetermined ratio or less of the total amount of the ink; and a liquid injecting unit, described below.

The liquid extracting unit includes an ink trap 81 that recovers the cartridge 1 to be refilled after extracting the ink remaining in the cartridge 1; a suction pump 83 that reduces the pressure in the ink trap 81 through a trap pressure-reducing pipe 85, described below; the trap pressure-reducing pipe 85 for reducing the pressure of the ink trap 81 by the suction of the suction pump 83; and an ink suction pipe 87 for sucking the remaining ink from the cartridge 1.

An ink receiver 81*a* that receives the remaining ink sucked into the ink trap 81 is provided in the ink trap 81. An extracting jig for extracting the remaining ink in the cartridge 1 from the ink supply opening 4 is provided at an end of the ink suction pipe 87. Furthermore, the end (extracting jig) is connected with the ink supply opening 4, and the other end is disposed in the ink receiver 81*a* of the ink trap 81.

Basically, the extracting jig has the same structure as that of a mounting portion, to which the cartridge is mounted, in the liquid jet apparatus and includes the operating rod 70 for opening the ink supplying needle 72 inserted into the ink supply opening 4 or the atmosphere-communicating recessed portion 38 to the atmosphere. The extracting jig is disposed above the ink trap 81 and supports the cartridge 1 while facing the ink supply opening 4 downward. AS a result, the remaining ink drops into the ink trap 81 through the ink suction pipe 87 when extracted from the extracting jig.

An end of the trap pressure-reducing pipe 85 is connected with the suction pump 83, and the other end is disposed in an upper portion within the ink trap 81.

In the extracting and sucking process, the liquid refilling device having the above configuration drives the suction pump 83 and reduces the pressure of the ink trap 81 to a predetermined negative pressure (for example, about 100 Torr or 13.3 kPa) through the trap pressure-reducing pipe 85. In addition, the remaining ink is extracted from the cartridge 1 through the ink supply opening 4, and the extracted remaining ink is received by the ink receiver 81*a* of the ink trap 81. In the embodiment, the ink remaining in the used cartridge 1 is extracted from the ink supply opening 4 like the above.

As described above, when the ink remaining in the used cartridge 1 is extracted from the ink supply opening 4, ink is injected after the remaining ink is extracted. Therefore, the effect of inferior remaining ink can be reduced. In addition, since the ink remaining in the cartridge 1 is extracted from the ink supply opening 4, the ink flowing direction during extraction is identical to the ink flowing direction when the cartridge is used, so that the ink can be extracted smoothly with no difficulty. Furthermore, since the extracting jig having the same configuration as that of the liquid jet apparatus is used, common parts can be used, and thereby the cost of the device can be reduced. Still furthermore, the remaining ink can be extracted as smoothly as when the cartridge is used.

When the remaining ink in the cartridge 1 is extracted, a predetermined amount of liquid corresponding to the surface area of the cartridge 1 is made to remain in the cartridge 1. Specifically, the amount of ink to remain in the cartridge 1 is about 2.5 volume % (0.5 g in the embodiment) of the total amount of the ink to be refilled. As described above, if the predetermined amount of ink according to the surface area of the cartridge 1 is made to remain, the fluidity of the ink to a portion, into which ink is hard to flow (for example, narrow ink flow passage) or a portion, at which the ink is leaked, improves, and thereby the filling characteristic of the ink improves, and air bubbles rarely remain. In this case, a great amount of ink remains if the surface area of the cartridge 1 is large, and a small amount of ink remains if the surface area of the cartridge 1 is small, whereby the above function works effectively.

After that, in the remaining amount checking process, it is checked whether the amount of the ink remaining in the cartridge 1 after the ink is extracted occupies the predetermined ratio of the total amount of the ink to be refilled into the new cartridge.

The predetermined ratio is 6 volume % in the remaining amount checking process. That is, it is checked whether the amount of the ink remaining in the cartridge 1 occupies 6 volume % or less of the total amount of the ink to be refilled into the new cartridge.

In the embodiment, since 18.18 gram (g) of ink is filled in the new cartridge, it is checked whether the amount of the ink remaining in the cartridge 1 is 1 g or less, which is 6% (v/w) of 18.18 g.

Since the predetermined ratio in the remaining amount checking process is 6 volume %, it is possible to ensure the quality of the liquid until the influence of the inferior liquid remaining in the cartridge can be ignored, and the used cartridge can be refreshed by replacing the liquid in the used cartridge with refilling liquid reliably. In addition, the yield of the liquid to be refilled can be ensured while the remaining liquid is discharged sufficiently, and thereby both of the quality and yield of the liquid in the recycled cartridge can be ensured.

As described above, 'the ink extracting process' is completed by leaving 0.5 to 1 g of ink in the cartridge 1, and then next process begins.

After that (see FIG. 1), in 'the injection hole film piercing process', a part of the film F welded to the vicinity of the air discharge opening 21 of the cartridge 1 containing 1 g or less of remaining ink so as to seal the air discharge opening 21 is removed to communicate the air discharge opening 21 to the atmosphere.

Figure 15:
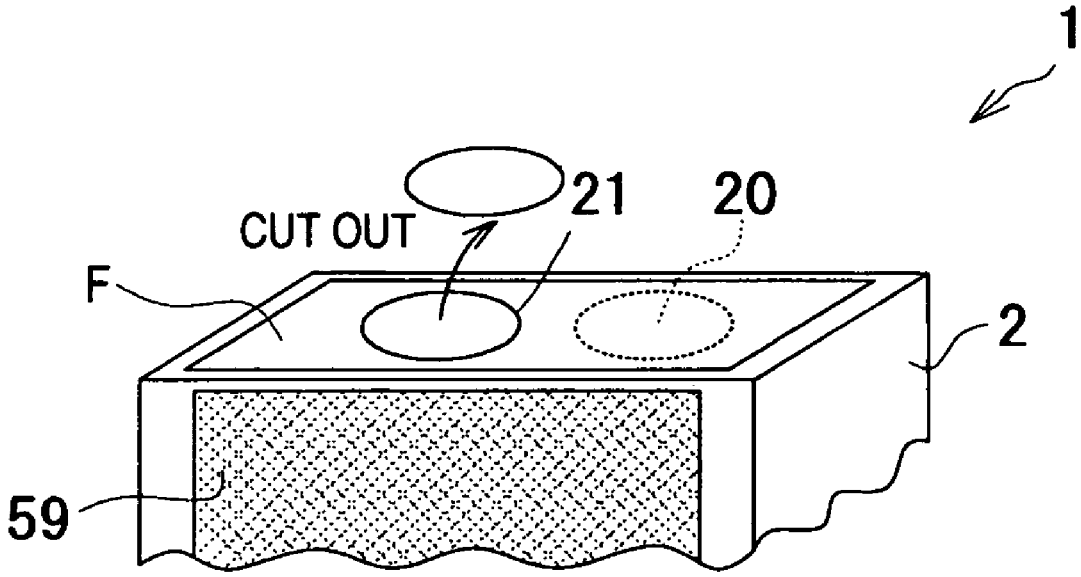
FIG. 15 is a view showing an injection hole film piercing process.

As shown in FIG. 15, in 'the injection hole film piercing process', specifically, when the part of the film F of the air discharge opening 21 is removed, the part of the film F of the air discharge opening 21 is cut out by a film removing unit (for example, scissors or cutter knife) or the like, and then a hole is formed in the film F of-the air discharge opening 21.

As described above, the part of the film F of the air discharge opening 21 is removed by cutting out the part of the film F and forming a through-hole in the film F of the air discharge opening 21. Furthermore, in 'the ink injecting process', ink is injected into the cartridge 1 from the air discharge opening 21. Since the air discharge opening 21 can be communicated without causing damage to the cartridge 1 or the like by forming a through-hole in the film F of the air discharge opening 21 as such, and thus the rewelding surface is rarely damaged, an injection hole film 90 (described later) can be rewelded to a surface with no damage, thereby achieving reliable rewelding. Furthermore, liquid can be injected efficiently in a short time while no air bubbles enter the cartridge 1.

In addition, although the removal of the film F to open the air discharge opening 21 in the present embodiment is realized in such a manner that the part of the film F is cut out along the edge of the air discharge opening 21 to form the through-hole in the film F, the present invention should not be restricted thereto 6r thereby, and the removal of the film F to open the air discharge opening 21 can be realized in various ways. For example, as shown by a two-dotted chain line in FIG. 15, the film F is cut out along the two-dotted chain line so that the left half of the film F is removed to open the air discharge opening 21, while the remaining right half of the film F keeps the sealing state of the ink injection opening 20. Alternatively, the entire film F may be removed to open both the air discharge opening 21 and the ink injection opening 20.

After that, in 'the ink injecting process', ink is injected into the cartridge 1.

Figure 16:
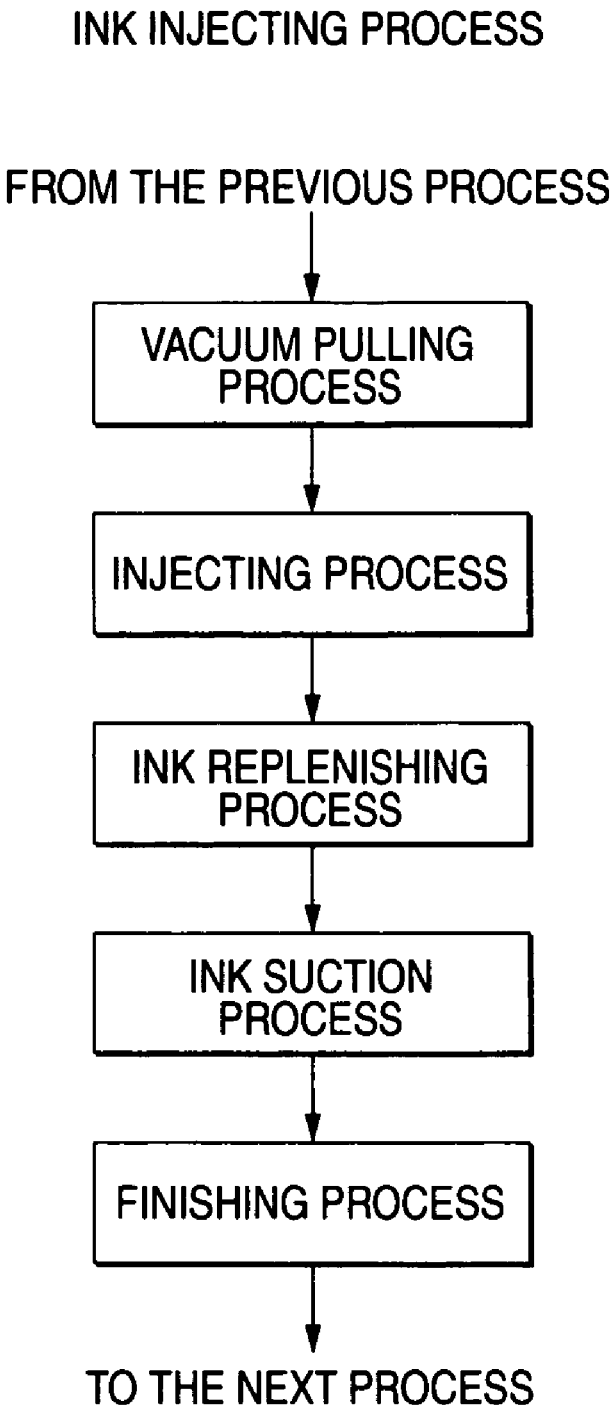
FIG. 16 is a view showing an ink injecting process.

As shown in FIG. 16, in the 'ink injecting process', by using a liquid injecting unit, described below, a vacuum pulling process, in which the pressure of the cartridge 1, from which the ink is extracted in the 'ink extracting process', is reduced to a predetermined vacuum degree (37 Pa in the example) or less; an injecting process, in which ink is injected into the cartridge 1; an ink replenishing process, in which ink is replenished into the temporary reservoir tank 93, described below; an ink suction process, in which a predetermined amount of ink is sucked from the cartridge 1 through the ink supply opening 4 after ink is injected in the injecting process; and a finishing process, in which 'the ink injecting process' is finished, are performed in sequence.

Figure 17:
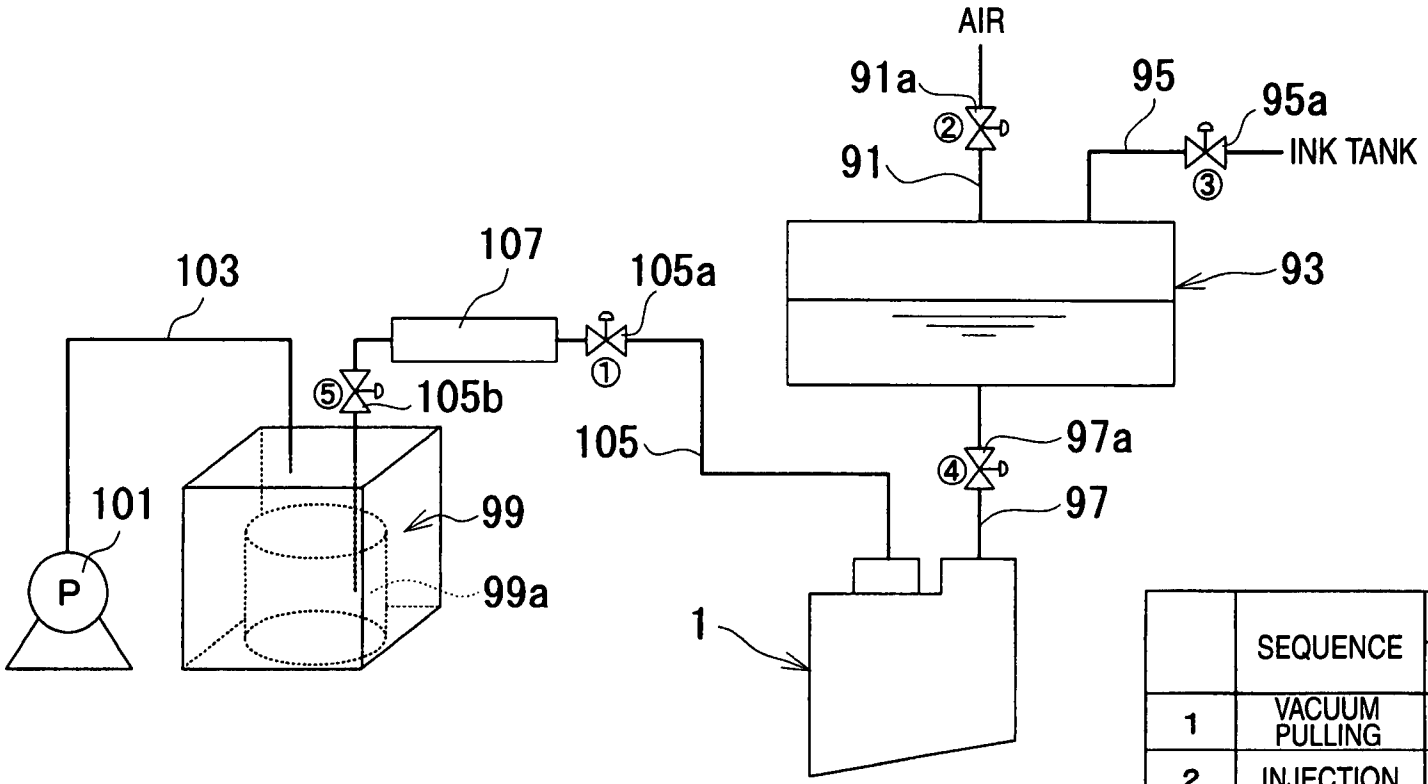
FIG. 17 is a view showing a liquid injection unit used in the ink injecting process.

FIG. 17 shows the liquid injecting device of the liquid refilling device according to the invention. In the device, the liquid injecting unit includes the temporary reservoir tank 93 having a communication pipe 91 that communicates with the atmosphere connected with the upper portion thereof and reserving the ink to be refilled into the cartridge 1 above the cartridge 1 checked to contain the amount of the remaining ink measured by the measuring device 89 equal to or less than the predetermined ratio (6 volume %); a supply pipe 95 connected with the ink tank accommodating the ink in order to supply the ink to the temporary reservoir tank 93; the injection pipe 97 for injecting the ink in the temporary reservoir tank 93 into the cartridge 1 from the air discharge opening 21; the ink trap 99 that extracts and accommodates the ink in the cartridge 1; the suction pump 101 that reduces the pressure of the ink trap 99 through the trap pressure-reducing pipe 103, described below; the trap pressure-reducing pipe 103 for reducing the pressure of the ink trap 99 by the suction of the suction pump 101; and an ink suction pipe 105 for sucking the ink from the cartridge 1.

The liquid injecting unit injects ink into the cartridge checked to contain the amount of remaining ink measured by the measuring device 89 equal to or less than the predetermined ratio (6 volume %) by the above configuration.

A communication pipe opening and closing valve 91*a* that opens and closes the communication pipe 91 and controls the ventilation of the air to the temporary reservoir tank 93 is provided in the communication pipe 91. In addition, a supply pipe opening and closing valve 95*a* that opens and closes the supply pipe 95 and controls the supplying of the ink to the temporary reservoir tank 93 is provided in the supply pipe 95. Furthermore, an injection pipe opening and closing valve 97*a* that opens and closes the injection pipe 97 and controls the injection of the ink into the cartridge 1 is provided in the injection pipe 97.

The ink receiver 99*a* that receives the remaining ink sucked into the ink trap 99 is provided in the ink trap 99. A suction jig for sucking the ink in the cartridge from the ink supply opening 4 is provided at an end of the ink suction pipe 105. In addition, the end, at which the suction jig is provided, is connected with the ink supply opening 4, and the other end is disposed in the ink receiver 99*a* of the ink trap 99.

The suction jig supports the cartridge 1 with the ink supply opening 4 facing upward on the suction jig. That is, the cartridge 1 is disposed lower than the suction jig with the ink supply opening 4 facing upward. With the above configuration, when the ink in the cartridge includes air bubbles, the air bubbles near the ink supply opening 4 can be gathered, and thereby the air bubbles near the ink supply opening 4 can be sucked and removed reliably. Even though the ink supplying needle 72 to be inserted into the ink supply opening 4 is provided in the suction jig, no operating rod 70 is provided.

An end of the trap pressure-reducing pipe 103 is connected with the suction pump 101, and the other end is disposed in the upper portion of the ink trap 99.

A liquid holding portion 107 having a volume corresponding to the amount of liquid sucked from the ink supply opening 4 in the ink suction process, described below, (about 4 cc in the embodiment) is provided in the ink suction pipe 105. In addition, an upstream suction pipe opening and closing valve 105*a* that opens and closes the ink suction pipe 105 between the cartridge 1 and the liquid holding portion 107 and controls the suction of the ink into the liquid holding portion 107 is provided upstream of the liquid holding portion 107 in the ink suction pipe 105. Furthermore, a downstream suction pipe opening and closing valve 105*b* that opens and closes the ink suction pipe 105 between the ink trap 99 and the liquid holding portion 107 and controls the suction of the ink into the ink trap 99 is provided downstream of the liquid holding portion 107 in the ink suction pipe 105.

The ink trap 99, the suction pump 101, the ink suction pipe 105, the upstream suction pipe opening and closing valve 105*a*, the downstream suction pipe opening and closing valve 105*b*, the liquid holding portion 107 and the like act as the suction unit that sucks a predetermined amount of ink from the cartridge 1 through the ink supply opening 4.

In the 'vacuum inducing process', the suction pump 101 is activated, and the upstream suction pipe opening and closing valve 105*a* and the downstream suction pipe opening and closing valve 105*b* are closed. In addition, the communication pipe opening and closing valve 91*a*, the supply pipe opening and closing valve 95*a*, and the injection pipe opening and closing valve 97*a* are closed, and the pressure in the cartridge 1 is reduced so as to be in a range of about 600 Pa (about 5 torr) to about 3800 Pa (about 28 torr).

The vacuum degree in the cartridge 1 can be set preferably in a range of 5 to 28 torr, more preferably in a range of 10 (about 1300 Pa) to 28 torr by controlling the suction of the suction unit by, for example, a suction control unit or the like that controls the suction unit.

In the injecting process, the activation of the suction pump 101 is stopped, the communication pipe opening and closing valve 91*a* and the injection pipe opening and closing valve 97*a* are opened, and the upstream suction pipe opening and closing valve 105*a*, the supply pipe opening and closing valve 95*a*, and the downstream suction pipe opening and closing valve 105*b* are closed. As a result, the ink in the temporary reservoir tank 93 is injected from the air discharge opening 21 into the cartridge 1, the pressure of which is reduced in advance to a range of about 600 to 3800 Pa, and which is checked to contain the amount of the remaining ink equal to or less than 6 volume % (1 g in the embodiment) in the remaining amount checking process.

As described above, the ink is injected into the cartridge 1 in a state where the pressure of the cartridge 1, from which the ink is extracted in 'the ink extracting process', is reduced in advance to a range of 600 to 3800 Pa. As a result, since the ink is injected in a state where the air in the cartridge 1 is sufficiently removed, the ink can be refilled smoothly while no air bubbles enter the cartridge 1. Particularly, a cartridge in which a pressure control valve is built, like the cartridge of the embodiment, is effective since the resistance of the air passing through the pressure control valve exerts a bad influence on a filling property or leaves air bubbles when air bubbles exist in the cartridge 1. In addition, since the pressure in the cartridge is not reduced excessively, it can be prevented that a small amount of ink remaining in the cartridge 1 is evaporated and solidified, or severe bubbling exerts a bad influence upon a filling property.

Furthermore, since it is checked whether the amount of the ink remaining in the cartridge 1 after the ink is extracted occupies the predetermined ratio of the total amount of the ink to be refilled into the cartridge, and the ink is injected only into the cartridge checked to contain the amount of the remaining ink equal to or less than the predetermined ratio, it is possible to control the amount of the ink remaining in the cartridge 1 in order that the effect of the remaining ink to the ink to be filled into the cartridge 1 (for example, inferior ink suffering from the reduction of the degassed rate, the viscosity increase due to drying or the like) can be almost ignored, and thereby the quality of the ink in the used cartridge 1 can be ensured. Still furthermore, the yield of the ink to be replenished can be ensured while the remaining ink is discharged sufficiently, and both of the quality and yield of the ink in the recycled cartridge can be ensured.

Still furthermore, the liquid refilling device extracts the remaining ink in the used cartridge 1 by the liquid extracting unit. In addition, the measuring device 89 measures whether the amount of the ink remaining in the cartridge 1 after the remaining ink is extracted occupies the predetermined ratio or less, and the liquid injecting unit injects refilling ink into the cartridge containing the amount of the remaining ink equal to or less than the predetermined ratio of the total amount of the liquid filled into the new cartridge, and thereby the running cost or recycling cost of the device can be decreased.

Still furthermore, since ink is injected into the cartridge 1, from which the ink is extracted in the ink extracting process, from the air discharge opening 21, which is the second opening, not from the ink supply opening 4, the ink can be injected in a short time while no air bubbles enter.

Still furthermore, since the air discharge opening 21 is an opening that communicates with the upstream ink reservoir chamber (the first ink chamber 11) by the differential pressure valve (pressure control valve) composed of the membrane valve 52, the spring 50 or the like, the ink is injected in the same direction as the ink flowing direction when the cartridge is used, and thereby the ink can be injected smoothly while air bubbles seldom tangle or remain.

After that, in the ink replenishing process, the communication pipe opening and closing valve 91*a* and the supply pipe opening and closing valve 95*a* are opened, and the upstream suction pipe opening and closing valve 105*a*, the injection pipe opening and closing valve 97*a* and the downstream suction pipe opening and closing valve 105*b* are closed, and thereby ink in the ink tank is supplied to the temporary reservoir tank 93.

In the ink suction process, the suction pump 101 is activated, and the downstream suction pipe opening and closing valve 105*b* is opened. In addition, the other opening and closing valves are closed, and the predetermined negative pressure (about 100 Torr, that is, about 133000 Pa in the embodiment) retains in the liquid holding portion 107. After that, the downstream suction pipe opening and closing valve 105*b* is closed, and the upstream suction pipe opening and closing valve 105*a* is opened, and thereby the ink is sucked from the cartridge 2 as much as the volume of the liquid holding portion 107 (about 1.12 g: 1 to 4 cc in the embodiment).

As described above, in the ink suction process, the negative pressure applied to the vicinity of the ink supply opening 4 is increased abruptly from a state where the predetermined negative pressure is accumulated in the liquid holding portion 107 by opening the upstream suction pipe opening and closing valve 105*a* provided upstream of the liquid holding portion 107. Therefore, even the ink containing air bubbles filled in the cartridge 1 is sucked strongly, and the ink containing no air bubbles is filled into the ink supply opening 4 or the like, and thereby liquid can be reliably jetted from the liquid jet apparatus. As described above, since strong negative pressure can be applied to the vicinity of the ink supply opening 4 with no particular increase in the sucking force, air bubbles or liquid can be sucked reliably by simple equipment.

In addition, after ink is injected into the cartridge 1, a predetermined amount of ink is sucked from the cartridge 1 through the ink supply opening 4. Therefore, air bubbles seldom remain in the cartridge 1 when the predetermined amount of ink is sucked through the ink supply opening 4 after the injection of the ink. Furthermore, air bubbles around the ink supply opening that has the largest effect can be removed, and thereby the refilled cartridge can ensure the jetting stability of the liquid jet apparatus as much as the new cartridge. Still furthermore, when air bubbles are extracted, no pressure is applied to the cartridge 1 from the outside, and thereby the cartridge is rarely damaged, and the cartridge can be recycled more times.

As described above, in the 'ink suction process', at least the amount of the ink corresponding to the volume of the flow passage from the differential pressure valve to the ink supply opening 4 in the ink supply opening 4 in the cartridge 1 is sucked from the liquid holding portion 107 at constant volume and vacuum degree, and the ink is sucked and held in the liquid holding portion 107 having the volume corresponding to the amount of the liquid sucked from the ink supply opening 4. With the above operation, the air bubbles in the flow passage from the differential pressure valve to the ink supply opening 4 can be removed reliably. Even when air bubbles exist upstream of the differential pressure valve, since no air bubbles can enter a portion downstream of the differential pressure valve, jetting troubles can be prevented reliably.

In addition, since the ink can be sucked from the ink supply opening 4 as much as the volume of the liquid holding portion 107 by sucking and holding the ink in the liquid holding portion 107 having the volume corresponding to the amount of the liquid sucked from the ink supply opening 4 in 'the ink suction process', a constant volume of ink can be sucked at all times, and the loss of ink due to excessive suction or the air bubble remaining due to the suction shortage can be prevented reliably.

In the finishing process, the activation of the suction pump 101 is stopped, and all valves are closed so as to complete the 'ink injecting process'. After that, the next process begins.

In addition, in case where the entire film F is removed to open both the air discharge opening 21 and the ink injection opening 20, it is necessary to seal the ink injection opening 20 prior to the 'ink injection process'. Therefore, in this case, similarly to the 'injection hole film rewelding process' described below, the ink injection opening 20 is sealed by a film such that the film is welded to a surface of the ink cartridge other than the originally welded surface, and thereafter the 'ink injection process' is carried out.

In the 'injection hole film rewelding process' (see FIG. 1), a heater 113, the rewelding unit, rewelds the injection hole film 90 to a surface (flat surface) other than the originally welded surface (flat surface) in order to-cover the through-hole formed in the film F and seal again the air discharge opening 21, through which ink has been injected in the ink injecting process. With the above process, it is possible to obtain welding quality ensuring welding strength having no liquid leakage with no-change in the shape of the cartridge 1. In addition, since a new film is used as the injection hole film 90, the reliability against the life span deterioration can be ensured. Furthermore, since the injection hole film 90 is rewelded to the portion other than the originally welded surface, the welding reliability increases.

Figure 18:
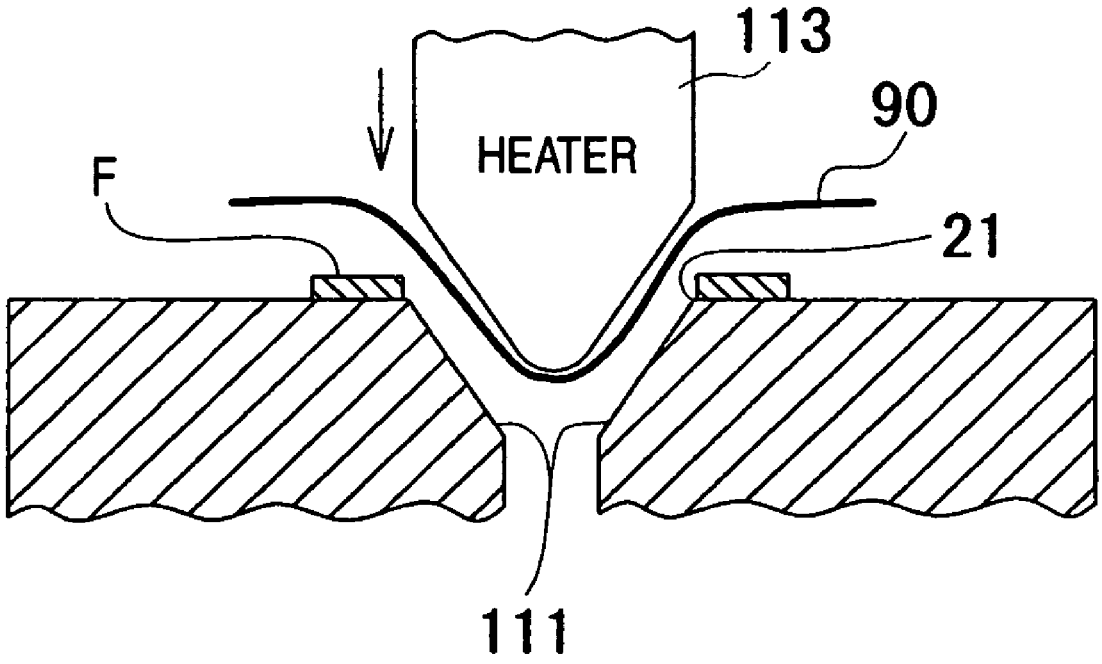
FIG. 18 is a view showing an injection hole film rewelding process.

Specifically, as shown in FIG. 18, an inclined surface 111 that inclines downward to the cartridge 1 from the opening is formed at the air discharge opening 21 of the cartridge 1. The rewelded surface is formed by the heater 113 at a portion deeper than the originally welded surface around the air discharge opening 21. With the above configuration, the rewelded surface is placed deeper than the surroundings and covered with the injection hole film 90, and thereby the rewelded surface is rarely damaged while the cartridge is being used. Thus, the film can be rewelded to a surface with no damage, and thereby the film can be rewelded reliably.

More specifically, the injection hole film 90 is welded to the inclined surface 111 as the rewelded surface. Then, since the film is rewelded to the inclined surface 111 that inclines downward to the cartridge 1 from the opening edge, the film can be welded easily with a welding jig (heater 113) along the slope, and thereby the air discharge opening 21 can be sealed more reliably.

Meanwhile, in the rewelding, it is possible to use an elastic film, and thereby the injection hole film 90 changes the shape for rewelding, and to use a non-elastic film, and thereby the injection hole film 90 is wrinkled for rewelding. In this case, the air discharge opening 21 can be sealed tightly along the shape of the rewelded surface, and thereby the cartridge appears neat and the ink leakage can be prevented more reliably.

According to the refilling cartridge, users can reuse the refilling cartridge having a welding quality that ensures a welding strength including no liquid leakage with no change in the shape of the cartridge. In addition, since a new film is used as the injection hole film 90, the reliability against the life span deterioration can be ensured. Furthermore, since the film is rewelded to the portion other than the originally welded surface, the welding reliability increases, and the user-satisfaction improves.

In the 'supplying opening rewelding process' (see FIG. 1), the supplying opening film is rewelded in order to seal the ink supply opening 4 again by the heater. Here, like the 'injection hole film rewelding process', the film can be rewelded to a portion other than the originally welded surface or to the inclined surface of the ink supply opening 4.

After that (see FIG. 1), in the 'weight inspecting process', the weight of the cartridge 1 is inspected, and it is checked whether the refilled cartridge 1 has the same weight as that of the new cartridge. Specifically, since the weight of the new cartridge is about 20.5 g, if the measured weight of the refilled cartridge 1 is in a range of 20.5±1 g, the next process begins.

After that, in the 'IC data writing process', the IC checker, an information writing unit that writes information, such as the recycling information, of the IC chip 49 writes the recycling information in the IC chip 49 of the cartridge 1.

The recycling information includes the number of recycling (recycling number) of the cartridge 1 or the like, and in the 'IC data writing process', the recycling number is increased by 'one'.

Meanwhile, in the 'sorting process', when the IC checker reads the information stored in the IC chip 49, if the recycling number exceeds a predetermined number, the cartridge 1 provided at the IC chip 49 can be removed as NG, or the number can be reported by a certain reporting unit. With the above operation, the recycling number can be managed. In addition, since the parts deteriorate, it is possible to prevent that the cartridge is recycled repeatedly and damaged cartridges are on sale.

Furthermore, when the cartridge 1 is used in the recording device, the amount of remaining ink is stored in the IC chip, and the amount of remaining ink is read from the IC chip 49 in the 'ink extracting process', and then the amount of ink corresponding to the read amount of the remaining ink can be extracted from the used cartridge 1. With the above operation, the amount of the remaining ink suitable for refilling can be extracted, and the ink in the used cartridge 1 can be replaced with the refilling ink more effectively.

Still furthermore, the measured amount of the remaining ink after ink extraction is stored in the IC chip in the 'ink extracting process', and then the amount of the remaining ink stored in the IC chip 49 can be read and whether the ink is to be injected is determined or the amount of ink corresponding to the amount of the remaining ink can be re-injected in the 'ink injecting process'. With the above operation, for example, it is possible to reliably inject ink into only the cartridge containing 1 g or less of the remaining ink. In addition, the amount of ink suitable for refilling can be injected.

Next, after the 'IC data writing process', the IC checker reads the information of the IC chip 49 of the cartridge 1 in order to check whether the information is written reliably in the 'IC data writing process'.

Next, in the 'lot imprinting process', the lot number is imprinted on the cartridge 1. Meanwhile, the imprint can be formed by thermal imprinting or stamp.

Next, in the 'label adhering process', a new label identifying the recycled one and a label for covering the vicinity of the air discharge opening 21 are adhered to the cartridge 1.

Next, in the 'external pressure inspecting process', the ink leakage from the cartridge 1 is inspected. In this process, the cartridge 1 is put in a box, the pressure in which is reduced to a predetermined negative pressure, and then it is checked whether the ink is leaked from the cartridge in the reduced pressure. In addition, if the container body 2 or the like is cracked or the ink is leaked from the cartridge, the cartridge is evaluated NG and removed.

Next, in the 'packing process', the cartridge 1 is reduced in pressure and packed in order not to let the ink in the cartridge 1 touch the air. As described above, since the cartridge 1 is reduced in pressure and packed, and the ink is blocked from the air, the degassed rate of the ink in the cartridge can be maintained sufficiently.

Next, in the '12 h leakage checking process', the pressure-reduced and packed cartridge 1 is left for 12 hours, and then it is checked whether the ink is leaked from the cartridge 1 or the air enters the pressure-reduced and packed cartridge 1.

Next, in the 'individual encasing process', high quality refilled cartridges 1, from which the ink is not leaked, are encased.

So far, an example of the method of refilling liquid into a cartridge according to the embodiment has been described.

As described above, in the method of liquid refilling, the cartridge 1 can be reused by injecting ink into the used cartridge 1, and the decrease in environmental load accompanied by the reduction of waste and the cost down owing to the reusing of parts can be achieved, and thereby users can be provided with cartridge at a low price. In addition, since it is not required to apply external pressure to the cartridge 1, the cartridge is rarely damaged, and the cartridge can be recycled more times. As described above, since the used cartridge can be recycled effectively with a simple process, a user can be provided with a high-quality used cartridge at a low recycling cost.

In the present embodiment, the through-hole is formed through the film F to open the air discharge opening 21 in order to enable ink inject, and after the ink injection, the different injection hole film 90 is welded to the surface, other than the originally welded surface, as the welded surface to cover the through-hole formed in the injection hole film F, to thereby seal the air discharge opening 21 again. However, any other means can be employed as long as the air discharge opening 21 can be sealed and hermetically closed. Therefore, the present invention should not be restricted to the use of the film nor the welding for the fixation.

Figure 19:
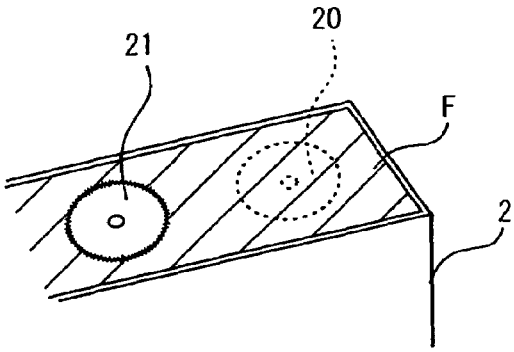
FIG. 19(*a*) is a schematic perspective view showing a state in which an air discharge opening is opened by removing a part of a film, and FIG. 19(*b*) is a schematic perspective view showing a state in which the air discharge opening is sealed after injection of ink.
Figure 19:
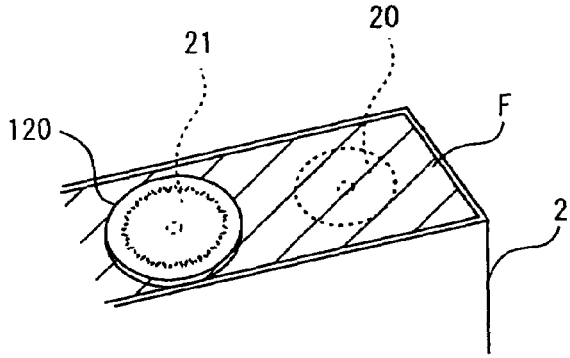
Figure 20:
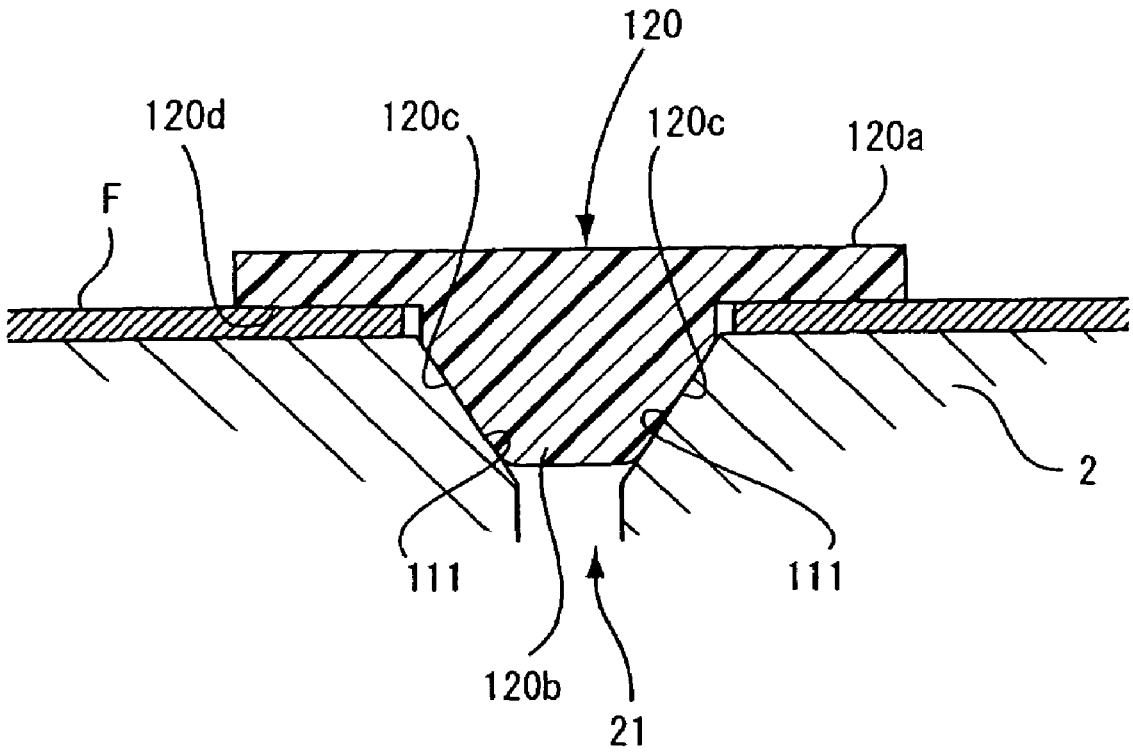
FIG. 20 is a cross-sectional view showing a state in which the air discharge opening is sealed.

For example, an example of modification is illustrated in FIGS. 19 and 20, which seals the air discharge opening 21. FIG. 19(*a*) is a schematic perspective view showing a state in which the air discharge opening 21 is opened by removing a part of the film F. FIG. 19(*b*) is a schematic perspective view showing a state in which the air discharge opening 21 is sealed after injection of ink. FIG. 20 is a cross-sectional view showing a state in which the air discharge opening 21 is sealed.

As shown in FIG. 19(*b*), in the present modification, after the ink injection, a sealing plug 120 made of elastic material such as resin is used to seal the air discharge opening 21. That is, in the present modification, the sealing plug 120 is used as the sealing member.

As shown in FIGS. 19(*b*) and 20, the sealing plug 120 includes a flange portion 120*a* having a circular shape as viewed from above, and a sealing portion 120*b* protruded from one surface 120*d* of the flange portion 120*a* at a center thereof. The sealing portion 120*b* is formed integral with the flange portion 120*a*, and has an outer circumferential surface 120*c* matching in shape with a tapered shape of the inclined surface 111. When the air discharge opening 21 is sealed, the sealing portion 120*b* of the sealing plug 120 is inserted into the air discharge opening 21 so that the outer circumferential surface 120*b* is closely contacted with the inclined surface 111 of the air discharge opening 21 due to the elasticity of the sealing portion 120*b*. The sealing plug 120 is fixed in this state. Concurrently, the one surface 120*d* of the flange portion 120*a* is pressed against and closely contacted with the film F so as to establish the sealing between the film F and the flange portion 120*a*. The air discharge opening 21 is sealed in this fashion.

In the present embodiment also, the sealing is realized at the inclined surface 111 recessed from the circumstances. This inclined surface, before the ink injection, is covered and protected by the injection hole film F and therefore is rarely damaged. The sealing portion 120*b* of the sealing plug 120 can be closely contacted with a surface with no damage to achieve the reliable sealing after the ink injection.

In the present modification, the sealing plug 120 having a predetermined shape is used as the sealing member. However, the present invention should not be restricted thereto. For example, a (glue-like) resin (such as an elastic member having non-fixed shape) that does not have a predetermined shape and that is easily deformable can be used as the sealing member to seal the air discharge opening 21. This resin may, for example, have a tacky property matching with the material of the container body of the ink cartridge 1. In this case also, to seal the air discharge opening 21, the resin is pressed against the inclined surface 111, which is protected and clean surface, and therefore the reliable sealing can be realized.

In the present embodiment, the air discharge opening 21 is used to refill ink into the ink cartridge. The present invention may be embodied such that the ink injection opening 20, instead of the air discharge opening 21, is used to refill ink into the ink cartridge, or both of the air discharge opening 21 and the ink injection opening 20*a* reused to refill ink into the ink cartridge.

In addition, ink for refilling may be ink of the same color, or may be ink of the same color group or ink of similar color. Here, the ink of the same group means ink having colorant or color material of the same group, which has substantially the same chromatic characteristic as that of ink filled originally and consumed (for example, red ink and light red ink, etc.), and the ink of similar color means ink having colorant or color material which has similar chromatic characteristic as that of ink filled originally and consumed (for example, red ink and orange ink, etc.) Moreover, in some cases, the liquid for refilling may be ink which is completely different in color from the ink filled originally and consumed.

Even though the embodiment deals with a case in which liquid is refilled into a used cartridge, the present invention is also applicable to a case in which liquid is filled into a new cartridge.

Even though the embodiment deals with the ink jet recording device, the liquid jet apparatus can jet not only ink but also glue, manicure, conductive liquid (liquid metal) or the like. In addition, even though the embodiment deals with the ink jet recording head using ink that is a liquid, the invention can be applied to a recording head used for an image recording device, such as a printer; a pigment jet head used in the manufacturing of a color filter, such as liquid crystal display or the like; an electrode forming material jet head used in the electrode forming such as organic EL display, FED (surface light-emitting display) or the like; a liquid jet apparatus that eject liquid such as a bio-organic jet head used in the manufacturing of a bio chip or the like.

What is claimed is:

1. A method for refilling ink into an ink cartridge, comprising:

providing the ink cartridge, which comprises;

a container body;

an ink chamber formed in the container body;

an ink supply opening, formed in a first side of the container body and adapted to receive an ink supplying needle of a printer, for communication between the ink chamber and a print head of the printer;

an ink injection opening formed in the first side of the container body and communicating with the ink chamber; and a film member attached to the container body and sealing the ink injection opening:

forming a through-hole through the film member to unseal the ink injection opening;

injecting ink into the ink chamber through the through hole and the ink injection opening; and sealing the ink injection opening after the injecting by attaching a sealing member to the container body so that a first part of the sealing member covers at least a part of the film member and a second part of the sealing member extends through the through-hole and liquid-tightly contacts an interior surface of the ink injection opening which is located between the film member and the ink chamber.

2. The method according to claim 1, wherein the provided ink cartridge further comprises a differential pressure valve mechanism which is disposed in at a part of a fluid passage connecting the ink chamber to the ink supplying opening, which blocks the fluid passage normally and which opens the fluid passage in accordance with a difference of ink pressure between the ink supply opening and the ink chamber generated by consumption of ink by the print head, wherein the injecting is performed while applying a negative pressure to the ink supplying opening so that the differential pressure valve mechanism opens the fluid passage.

3. The method according to claim 2, further comprising the step of thermally welding the part of the sealing member to the interior surface of the ink injection opening.

4. An ink cartridge comprising:

a container body;

an ink chamber formed in the container body;

an ink supply opening, formed in a first side of the container body and adapted to receive an ink supplying needle of a printer, for communication between the ink chamber and a print head of the printer;

an ink injection opening formed in the first side of the container body and communicating with the ink chamber;

a film member attached to the container body, and having a through-hole facing the ink injection opening; and a sealing member attached to the container body and having a first part covering at least a part of the film member and a second part extending through the through-hole and being in liquid-tight contact with an interior surface of the ink injection opening which is located between the film member and the ink chamber.

5. The ink cartridge according to claim 4, further comprising:

a differential pressure valve mechanism which is disposed at a part of a fluid passage connecting the ink chamber to the ink supplying opening, which blocks the fluid passage normally and which opens the fluid passage in accordance with a difference of ink pressure between the ink supply opening and the ink chamber generated by consumption of ink by the print head.

6. The ink cartridge according to claim 4, wherein the part of the sealing member is welded to the interior surface of the ink injection opening.

7. An ink cartridge comprising a container body an ink chamber formed in the container body;

an ink supply opening, formed in a first side of the container body and adapted to receive an ink supplying needle of a printer, for communication between the ink chamber and a print head of the printer;

an ink injection opening formed in the first side of the container body and communicating with the ink chamber;

a film member attached to the container body, and having a through-hole facing the ink injection opening; and a sealing member attached to the container body and having a part extending over the film member and the injection opening.

8. The ink cartridge according to claim 7, further comprising:

a differential pressure valve mechanism, disposed at a part of a fluid passage connecting the ink chamber to the ink supplying opening, and configured to normally block the fluid passage and to open the fluid passage in accordance with a difference of ink pressure between the ink supply opening and the ink chamber due to consumption of ink by the print head.

9. The ink cartridge according to claim 7, wherein the sealing member is a film member.

10. The ink cartridge according to claim 7, wherein the sealing member is a plug member.

11. A method for refilling ink into an ink cartridge, comprising:

providing an ink cartridge which comprises:

a container body:

an ink chamber formed in the container body;

an ink supply opening, formed in a first side of the container body and adapted to receive an ink supplying needle of a printer, for communication between the ink chamber and a print head of the printer;

an ink injection opening formed in the first side of the container body and communicating with the ink chamber; and a film member attached to the container body and sealing the ink injection opening;

forming a through-hole through the film member to unseal the ink injection opening;

injecting ink into the ink chamber through the through-hole and the ink injection opening; and sealing the ink injection opening after the injecting by attaching a sealing member to the container body so that the sealing member has a part extending over the film member and the ink injection opening.

12. The method according to claim 11, wherein:

the provided ink cartridge further comprises a differential pressure valve mechanism which is disposed in at a part of a fluid passage connecting the ink chamber to the ink supplying opening, which is configured to normally block the fluid passage and to open the fluid passage in accordance with a difference of ink pressure between the ink supply opening end the ink chamber due to consumption of ink by the print head; and the injecting is performed under a condition that a negative pressure is applied to the ink supplying opening and the differential pressure valve mechanism opens the fluid passage.

13. The method according to claim 11, wherein a part of the sealing member is thermally welded to a surface of the container body.

14. The method according to claim 11, further comprising:

extracting ink remaining in the ink chamber by way of the liquid supply opening before the injecting is performed.

15. The method according to claim 11, further comprising:

peeling off a sealing film attached to the ink supply opening before the injecting is performed.

16. The method according to claim 11, further comprising:

welding a sealing member to the ink supply opening after the injecting is performed.

* * * * *

UNITED STATES PATENT AND TRADEMARK OFFICE

CERTIFICATE OF CORRECTION

PATENT NO. : 7,658,480 B2
APPLICATION NO. : 11/288671
DATED : February 9, 2010
INVENTOR(S) : Uehara et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 484 days.

Signed and Sealed this

Twenty-eighth Day of December, 2010

David J. Kappos

David J. Kappos
*Director of the United States Patent and Trademark Office*